US009131758B2

(12) United States Patent
Stein

(10) Patent No.: US 9,131,758 B2
(45) Date of Patent: Sep. 15, 2015

(54) KEY LOCATOR WITH A CONTAINER

(75) Inventor: Sandra Stein, Los Angeles County, CA (US)

(73) Assignee: The Finding IP Holding Company LLC, West Hills, CA (US)

( * ) Notice: Subject to any disclaimer, the term of this patent is extended or adjusted under 35 U.S.C. 154(b) by 465 days.

(21) Appl. No.: 13/073,789

(22) Filed: Mar. 28, 2011

(65) Prior Publication Data

US 2012/0067912 A1 Mar. 22, 2012

Related U.S. Application Data

(63) Continuation-in-part of application No. 12/468,012, filed on May 18, 2009, now Pat. No. 8,672,002, which is a continuation of application No. 11/977,891, filed on Oct. 26, 2007, now Pat. No. 7,537,032, which is a continuation of application No. 10/919,494, filed on Aug. 17, 2004, now Pat. No. 7,308,922.

(51) Int. Cl.
*A45C 13/00* (2006.01)
*A45D 40/18* (2006.01)
(Continued)

(52) U.S. Cl.
CPC ..... *A45C 13/001* (2013.01); *A45D 40/18* (2013.01); *A45C 13/021* (2013.01); *A45C 13/08* (2013.01); *A45F 5/022* (2013.01); *A45F 2200/0558* (2013.01); *Y10T 24/3439* (2015.01)

(58) Field of Classification Search
CPC .... A45C 13/001; A45C 13/021; A45C 13/08; A45F 5/022; A45F 2200/0558; Y10T 24/3439
USPC ..... 24/3.6, 3.12, 335; 63/1, 1.2, 12, 43; 70/459; 150/104, 106, 100, 101.102; 190/102; 206/37.1; 224/666; D3/207, D3/211, 215; 220/751
See application file for complete search history.

(56) References Cited

U.S. PATENT DOCUMENTS 110,760 A 1/1871 Harrison
110,873 A 1/1871 Sinclair
(Continued)

FOREIGN PATENT DOCUMENTS

CA 2 531 767 A1 6/2007
CA 2 543 748 A1 6/2007
(Continued)

OTHER PUBLICATIONS

U.S. Appl. No. 10/919,494, filed Aug. 17, 2004, Stein.
(Continued)

*Primary Examiner* — Sue A Weaver
(74) *Attorney, Agent, or Firm* — Morgan, Lewis & Bockius LLP

(57) ABSTRACT

Provided is a key locator comprising a) a bent rod-shaped first member having opposing first and second end portions and b) a second member that selectively retains keys. The first member incorporates a bent interior region between the end portions. The end portions are not urged against each other and allow the bent interior region to hang from or clasp to an edge. The first end portion substantially permanently and flexibly engages with the second member. In one embodiment, the second end portion is substantially rigidly affixed to the key locator such that container movement necessarily causes key locator movement. In another embodiment, the container is rotatably mounted to the second end portion and comprises a hinge that attaches a first face to the container. The first face moves between an open configuration that exposes an interior portion of the container and a closed configuration that seals the interior portion.

49 Claims, 13 Drawing Sheets

(51) Int. Cl.

| | |
|---|---|
| *A45C 13/02* | (2006.01) |
| *A45C 13/08* | (2006.01) |
| *A45F 5/02* | (2006.01) |

(56) References Cited

U.S. PATENT DOCUMENTS

| | | | | | |
|---|---|---|---|---|---|
| 159,403 | A | | 2/1875 | Foster | |
| 195,400 | A | | 9/1877 | Richard | |
| 210,816 | A | | 12/1878 | Stevens | |
| 272,772 | A | | 2/1883 | Rieger | |
| 273,434 | A | | 3/1883 | Bagot | |
| 279,236 | A | | 6/1883 | Fletcher | |
| 279,267 | A | | 6/1883 | Nock | |
| D15,367 | S | | 8/1884 | O'Hara | |
| 334,101 | A | | 1/1886 | Buffum | |
| 345,407 | A | | 7/1886 | Besse | |
| 376,453 | A | | 1/1888 | Scott | |
| 376,825 | A | | 1/1888 | Kent | |
| 437,550 | A | | 9/1890 | Armentrout | |
| 448,892 | A | | 3/1891 | Staiger | |
| 520,053 | A | | 5/1894 | Hopkins | |
| 528,455 | A | | 10/1894 | Zeller | |
| 533,385 | A | | 1/1895 | Tweedale | |
| 603,247 | A | | 5/1898 | Becker | |
| 603,538 | A | | 5/1898 | Pettibone | |
| 629,213 | A | | 7/1899 | Sheets | |
| 629,224 | A | | 7/1899 | Watkins | |
| 649,217 | A | | 5/1900 | Scherer | |
| 652,996 | A | | 7/1900 | Cotter | |
| 686,124 | A | | 11/1901 | Parker | |
| 703,822 | A | | 7/1902 | Prahar | |
| 722,370 | A | | 3/1903 | Leslie | |
| 753,613 | A | | 3/1904 | McGill | |
| 780,962 | A | | 1/1905 | Perry | |
| 789,352 | A | | 5/1905 | Badger | |
| 843,050 | A | | 2/1907 | Wallerstedt | |
| 867,255 | A | | 10/1907 | Dietz | |
| 882,493 | A | | 3/1908 | Dodge | |
| 889,436 | A | | 6/1908 | Bustanoby | |
| 905,731 | A | | 12/1908 | Merrill | |
| 917,894 | A | * | 4/1909 | Pusterla | 70/408 |
| 932,787 | A | | 8/1909 | Kirby | |
| 938,723 | A | | 11/1909 | Swan | |
| 940,642 | A | | 11/1909 | Maass | |
| 946,620 | A | | 1/1910 | Stiggins | |
| 969,767 | A | | 9/1910 | Berg | |
| 995,686 | A | | 6/1911 | Koch | |
| 1,035,946 | A | | 8/1912 | Cardwell | |
| 1,039,900 | A | | 10/1912 | Collis | |
| 1,042,843 | A | | 10/1912 | Toce | |
| 1,053,183 | A | | 2/1913 | Keller | |
| 1,092,031 | A | | 3/1914 | En Earl | |
| 1,106,388 | A | | 8/1914 | Juergens | |
| 1,107,958 | A | | 8/1914 | Jorgensen | |
| 1,109,846 | A | | 9/1914 | Knap | |
| 1,110,760 | A | | 9/1914 | Easton | |
| 1,110,873 | A | | 9/1914 | Boye | |
| 1,155,032 | A | | 9/1915 | Baer | |
| 1,155,296 | A | | 9/1915 | Beuther | |
| 1,158,251 | A | | 10/1915 | McDougall | |
| 1,161,523 | A | | 11/1915 | Phillips | |
| 1,165,882 | A | | 12/1915 | Killion | |
| 1,198,105 | A | | 9/1916 | Butler | |
| 1,199,635 | A | | 9/1916 | Urmston | |
| 1,206,074 | A | | 11/1916 | Zweiner | |
| 1,208,936 | A | | 12/1916 | England | |
| 1,211,025 | A | | 1/1917 | Wright | |
| 1,229,855 | A | | 6/1917 | Alexander | |
| 1,281,656 | A | | 10/1918 | Raschick | |
| 1,283,557 | A | | 11/1918 | Raschick | |
| 1,314,392 | A | | 8/1919 | Glamzo | |
| 1,327,534 | A | | 1/1920 | Eichstedt | |
| 1,343,495 | A | | 6/1920 | Davis | |
| 1,363,567 | A | | 12/1920 | Cobb | |
| 1,364,709 | A | | 1/1921 | Butler | |
| 1,368,156 | A | | 2/1921 | Jackson | |
| 1,379,093 | A | | 5/1921 | Freeberg | |
| 1,388,100 | A | | 8/1921 | Davis | |
| 1,418,979 | A | | 6/1922 | Seferlis | |
| 1,419,408 | A | | 6/1922 | Polhemus | |
| 1,425,089 | A | | 8/1922 | Henry | |
| 1,454,468 | A | | 6/1923 | Crosby | |
| 1,462,205 | A | | 7/1923 | Korns | |
| 1,472,766 | A | | 10/1923 | Fraser | |
| 1,473,361 | A | | 11/1923 | Tebbetts | |
| 1,489,244 | A | | 4/1924 | Gnegy | |
| 1,490,871 | A | | 4/1924 | Wagner | |
| 1,566,206 | A | | 1/1925 | Greene | |
| 1,539,220 | A | | 5/1925 | Taylor | |
| 1,524,210 | A | | 7/1925 | Prentice | |
| 1,555,714 | A | | 9/1925 | Kahn | |
| 1,558,213 | A | | 10/1925 | Atkins | |
| 1,571,425 | A | | 2/1926 | Mataloni | |
| 1,578,157 | A | | 3/1926 | Miller | |
| 1,581,016 | A | | 4/1926 | Reiter | |
| 1,583,225 | A | | 5/1926 | Flanders | |
| 1,609,347 | A | | 12/1926 | Dee | |
| 1,618,573 | A | | 2/1927 | Cole | |
| 1,626,987 | A | | 5/1927 | Venegas | |
| 1,629,404 | A | | 5/1927 | Mitchell | |
| 1,648,016 | A | | 11/1927 | Freysinger | |
| 1,651,921 | A | | 12/1927 | Felz | |
| 1,652,972 | A | | 12/1927 | Beck | |
| 1,679,606 | A | | 8/1928 | Graves | |
| 1,683,545 | A | | 9/1928 | Harris | |
| 1,700,132 | A | | 1/1929 | Johnson | |
| 1,715,348 | A | | 6/1929 | Barbara | |
| 1,718,433 | A | | 6/1929 | Rivas | |
| 1,745,836 | A | | 2/1930 | Miller | |
| 1,766,801 | A | | 6/1930 | Ragsdale | |
| 1,817,246 | A | | 8/1931 | Gardine | |
| 1,835,793 | A | | 12/1931 | Lurie | |
| 1,934,889 | A | | 11/1933 | Segal | |
| 1,962,711 | A | | 6/1934 | Duffy | |
| 1,974,499 | A | | 9/1934 | Luce | |
| 2,008,471 | A | | 7/1935 | Schroeder | |
| 2,019,691 | A | | 11/1935 | Morehouse | |
| 2,026,185 | A | | 12/1935 | Lupfer | |
| 2,038,070 | A | | 4/1936 | Welch | |
| 2,051,432 | A | | 8/1936 | Zahn | |
| 2,076,895 | A | | 4/1937 | Johnston | |
| 2,079,401 | A | | 5/1937 | Eisenberg | |
| 2,117,989 | A | | 5/1938 | Ryan | |
| 2,126,826 | A | | 8/1938 | Shively | |
| 2,126,850 | A | | 8/1938 | Whitehead | |
| 2,138,994 | A | | 12/1938 | Bassler | |
| 2,144,755 | A | | 1/1939 | Freedman | |
| 2,159,223 | A | | 5/1939 | Okun | |
| 2,173,008 | A | | 9/1939 | Cheney | |
| 2,201,833 | A | | 5/1940 | Koelling | |
| 2,218,932 | A | | 10/1940 | Collins | |
| 2,219,075 | A | | 10/1940 | Le Veau | |
| 2,224,073 | A | | 12/1940 | Augenstein | |
| 2,224,972 | A | | 12/1940 | Long, Jr. et al. | |
| 2,231,308 | A | | 2/1941 | Walsh | |
| 2,232,503 | A | | 2/1941 | Zarowin | |
| 2,250,328 | A | | 7/1941 | Daniels | |
| 2,271,090 | A | | 1/1942 | Newman | |
| D131,492 | S | | 3/1942 | Lee | |
| 2,286,265 | A | | 6/1942 | Davio | |
| 2,292,563 | A | | 8/1942 | Imhoff | |
| 2,302,341 | A | | 11/1942 | Nash | |
| 2,307,808 | A | | 1/1943 | Segal | |
| 2,320,308 | A | | 5/1943 | Silverman | |
| 2,326,558 | A | | 8/1943 | Pelz | |
| 2,344,694 | A | | 3/1944 | Gardner | |
| 2,389,426 | A | | 11/1945 | Geffner | |
| 2,410,951 | A | | 11/1946 | Kuhnl | |
| 2,411,446 | A | | 11/1946 | Mars | |
| 2,457,195 | A | | 12/1948 | Bagnall | |
| 2,459,735 | A | | 1/1949 | McKinnon | |
| 2,484,547 | A | | 10/1949 | Bishop | |
| 2,487,897 | A | | 11/1949 | Rozsa | |
| 2,498,590 | A | | 2/1950 | Straus | |

(56) References Cited

U.S. PATENT DOCUMENTS 2,500,198 A 3/1950 Mullan
2,500,257 A 3/1950 Mahan
2,503,211 A 4/1950 Ormsbee
2,532,255 A 11/1950 Davis
2,547,524 A 4/1951 Gross
2,548,820 A 4/1951 Reis
2,564,242 A 8/1951 Wendt
2,567,602 A 9/1951 Higgins
2,569,629 A 10/1951 Everitt
2,571,609 A 10/1951 Powell
2,572,703 A 10/1951 Dennis
2,589,349 A 3/1952 Diefenbach
2,634,470 A 4/1953 Grafft
2,652,586 A 9/1953 Ramsberger
2,652,873 A 9/1953 Barricini
2,657,568 A 11/1953 Morrell
2,659,231 A 11/1953 Glubiak
2,679,674 A 6/1954 Hanna
2,692,108 A * 10/1954 Neivert ..... 248/215
2,737,698 A 3/1956 Falk
D178,482 S 8/1956 Bacon
2,771,768 A 11/1956 Tudor
2,777,180 A 1/1957 Keating et al.
2,777,492 A 1/1957 Kikuchi
2,783,926 A 3/1957 Wise
2,823,537 A 2/1958 Segal
2,825,447 A 3/1958 Kurland
2,834,389 A 5/1958 Major
2,868,254 A 1/1959 Saad
2,871,691 A 2/1959 Bacon
2,887,747 A 5/1959 Bellman
2,931,208 A 4/1960 Prim
2,938,375 A 5/1960 Wehrli
3,007,568 A 11/1961 Kurland
3,008,323 A 11/1961 Legat
3,016,224 A 1/1962 Hall
3,071,938 A 1/1963 Davidson
3,128,812 A 4/1964 Scheurer
3,132,504 A 5/1964 Beilis
3,141,546 A * 7/1964 Leopoldi ..... 206/0.81
3,146,925 A 9/1964 Ruderian
3,147,896 A 9/1964 Kehl
3,176,489 A 4/1965 Sonntag
3,262,479 A 7/1966 Leguillon
3,309,905 A 3/1967 Shepherd
3,365,684 A 1/1968 Stemke
3,379,041 A 4/1968 Ilanna
3,421,349 A 1/1969 St. Clair
3,469,424 A 9/1969 Shears
3,529,649 A 9/1970 Bennett
3,564,881 A 2/1971 Burniski
3,638,284 A 2/1972 Baker
3,657,909 A * 4/1972 Boswell ..... 70/457
3,659,759 A 5/1972 Walton
3,670,524 A 6/1972 Korwin
3,682,216 A 8/1972 Nelson
3,707,742 A 1/1973 Justice et al.
3,779,053 A 12/1973 Langwell
D229,870 S 1/1974 Czarny
3,822,446 A 7/1974 Silverstein
3,828,595 A 8/1974 Williams
3,857,142 A 12/1974 Hills
3,866,647 A 2/1975 Tarkowski
3,884,059 A 5/1975 McKee
3,886,773 A 6/1975 McGahee
3,934,317 A 1/1976 Langwell
3,970,227 A 7/1976 Hardy
4,004,325 A 1/1977 Hubachek
4,010,503 A 3/1977 Denton
4,079,767 A 3/1978 Howard
4,113,156 A 9/1978 Brito
4,124,881 A 11/1978 Haber
4,166,489 A 9/1979 Lemelson
D253,676 S 12/1979 Mathieson
4,184,304 A 1/1980 Merchant
4,194,714 A 3/1980 Schultz
4,201,259 A 5/1980 Alsdorf
4,210,302 A 7/1980 Serkez
4,210,306 A 7/1980 Schimmel
4,221,118 A 9/1980 Chicckine
4,226,105 A 10/1980 Wehrman
4,282,733 A 8/1981 Schmitt
4,306,434 A 12/1981 Drake
D262,498 S 1/1982 Beilis
4,319,384 A 3/1982 Horne
4,325,273 A 4/1982 Gibbons
4,349,975 A 9/1982 Chubb
4,359,888 A 11/1982 Scheineman
4,384,390 A 5/1983 Hayakawa
4,403,366 A 9/1983 Lucke
4,407,148 A 10/1983 Rousseau
4,430,778 A 2/1984 Sander
4,458,511 A 7/1984 Amelang
4,516,418 A 5/1985 Cuttler
4,523,443 A 6/1985 Momemers
4,576,839 A 3/1986 Parren
4,587,818 A 5/1986 Griffin
4,610,634 A 9/1986 Kimura
D285,989 S 10/1986 MacDonald
4,625,862 A 12/1986 Clayton
4,633,691 A 1/1987 Hardy
D288,984 S 3/1987 Scheurer et al.
4,658,455 A 4/1987 Skillern
4,665,594 A 5/1987 Wagner
4,705,086 A 11/1987 O'Neill
D296,726 S 7/1988 Katz
D298,781 S 12/1988 Thomas
4,881,150 A 11/1989 Oyamada
4,891,961 A 1/1990 Tsamas
4,907,694 A 3/1990 Miller
D307,671 S 5/1990 Satterly
4,923,235 A 5/1990 Stewart
D308,294 S 6/1990 Krassner
D308,762 S 6/1990 Barnes et al.
4,934,521 A 6/1990 Gebert
D309,830 S 8/1990 Kraus
4,955,422 A 9/1990 Irizarry
D311,451 S 10/1990 Chan
D312,172 S 11/1990 Ambrosio
4,976,124 A 12/1990 Sanders
5,031,430 A 7/1991 Nelson
5,044,049 A 9/1991 Owens
5,048,310 A 9/1991 Riley
5,052,081 A 10/1991 Fuehrer
5,069,050 A 12/1991 Chen
5,077,850 A 1/1992 Brubaker
5,078,484 A 1/1992 Vaughn
5,094,417 A * 3/1992 Creed ..... 248/215
5,098,324 A 3/1992 Isono
5,173,999 A 12/1992 Welk et al.
5,177,881 A 1/1993 Moore
5,183,153 A 2/1993 Linn
5,199,560 A 4/1993 Lee
5,228,149 A 7/1993 Phinn
D337,885 S * 8/1993 O'Brien ..... D3/208
D341,940 S 12/1993 MacDonald
5,312,029 A 5/1994 Tuber
5,331,721 A 7/1994 Raum, Sr.
D350,279 S 9/1994 Tate
D352,821 S 11/1994 Stillwagon
5,359,870 A 11/1994 Reutlinger
5,365,760 A 11/1994 Song
5,367,896 A 11/1994 Sundberg
D353,261 S 12/1994 Fort et al.
5,385,282 A 1/1995 Chen
D357,350 S 4/1995 Stillwagon
5,467,808 A 11/1995 Bell
D366,359 S 1/1996 Riedl
D371,325 S 7/1996 Fritsche
5,535,797 A 7/1996 Martindale
5,540,367 A 7/1996 Kauker
5,551,269 A 9/1996 Lewinstein et al.
D377,562 S 1/1997 Wolfram
D383,304 S 9/1997 Van Osch

(56) References Cited

U.S. PATENT DOCUMENTS

| | | | |
|---|---|---|---|
| D384,813 | S | 10/1997 | King |
| D385,415 | S | 10/1997 | Turbide |
| D392,201 | S | 3/1998 | Chen |
| D392,797 | S | 3/1998 | Kampe |
| 5,722,227 | A | 3/1998 | Stahlecker |
| 5,729,870 | A | 3/1998 | Sharp |
| 5,752,401 | A | 5/1998 | MacDonald |
| 5,768,915 | A | 6/1998 | Crumrine et al. |
| 5,768,924 | A | 6/1998 | Song |
| 5,778,495 | A | 7/1998 | Paugh |
| D396,552 | S | 8/1998 | Browne |
| 5,794,768 | A | 8/1998 | Skeffington |
| D398,775 | S | 9/1998 | Fritsche |
| D402,104 | S | 12/1998 | Kauker |
| 5,842,365 | A | 12/1998 | Bordonaro |
| D403,500 | S | 1/1999 | Winter |
| D403,501 | S | 1/1999 | Winter |
| D403,502 | S | 1/1999 | Winter |
| 5,864,925 | A | 2/1999 | McGee |
| 5,894,642 | A | 4/1999 | Eberhardt |
| 5,934,123 | A | 8/1999 | Eldredge |
| D413,434 | S | 9/1999 | Nielson |
| D416,675 | S | 11/1999 | MacDonald |
| 5,983,686 | A | 11/1999 | Lee |
| 6,017,072 | A | 1/2000 | Grant |
| 6,026,515 | A | 2/2000 | Nielson |
| 6,092,405 | A | 7/2000 | Berwick |
| D437,995 | S | 2/2001 | Perthou |
| D440,399 | S | 4/2001 | DeRouen et al. |
| D441,184 | S | 5/2001 | Haapala |
| 6,243,922 | B1 | 6/2001 | Simon |
| 6,318,610 | B1 | 11/2001 | Doherty |
| 6,334,239 | B1 | 1/2002 | Kraut |
| 6,345,796 | B1 | 2/2002 | Newman |
| D455,947 | S | 4/2002 | Goodman |
| 6,425,405 | B1 | 7/2002 | McRoberts |
| D462,172 | S | 9/2002 | Aureilio, Jr. |
| D468,091 | S | 1/2003 | Tipton |
| 6,536,081 | B2 | 3/2003 | Allen et al. |
| D474,239 | S | 5/2003 | Rosenbaum |
| 6,591,646 | B1 | 7/2003 | Huang |
| D478,207 | S | 8/2003 | Johnson |
| D478,719 | S | 8/2003 | Mercuri |
| 6,601,967 | B1 | 8/2003 | Zeller |
| 6,606,769 | B1 | 8/2003 | Harris |
| D479,768 | S | 9/2003 | Macevicz |
| D484,306 | S | 12/2003 | Lau |
| 6,681,608 | B1 | 1/2004 | Hope |
| 6,698,061 | B2 | 3/2004 | Ho |
| 6,772,614 | B1 | 8/2004 | Cheng |
| D499,545 | S | 12/2004 | Condiff |
| 6,843,086 | B2 | 1/2005 | Fitch |
| 6,870,483 | B1 | 3/2005 | Davis |
| D503,850 | S | 4/2005 | Staab |
| D504,222 | S | 4/2005 | Kieffer |
| 6,928,943 | B1 | 8/2005 | Neubauer |
| D510,185 | S | 10/2005 | Chan |
| 7,003,848 | B2 | 2/2006 | Ho |
| 7,021,852 | B1 | 4/2006 | Turner, III et al. |
| 7,093,468 | B2 | 8/2006 | Song |
| 7,185,996 | B1 | 3/2007 | Caprio |
| D539,526 | S | 4/2007 | Stein |
| 7,308,922 | B2 | 12/2007 | Stein |
| D560,067 | S | 1/2008 | Stein |
| D569,620 | S | 5/2008 | Stein |
| D581,655 | S | 12/2008 | Johnson |
| 7,537,032 | B2 | 5/2009 | Stein |
| 7,546,753 | B1 | 6/2009 | Kim |
| D598,646 | S | 8/2009 | Castaline |
| D602,687 | S | 10/2009 | Castaline |
| D607,636 | S | 1/2010 | Chiu |
| D611,703 | S | 3/2010 | Fahrendorff |
| D632,072 | S | 2/2011 | Fahrendorff |
| D635,763 | S | 4/2011 | Fahrendorff |
| 8,418,852 | B2 | 4/2013 | Ziemba |
| 8,499,933 | B2 | 8/2013 | Ziemba |
| 2003/0200687 | A1 | 10/2003 | Wolfe |
| 2003/0200779 | A1 | 10/2003 | Fitch |
| 2004/0020813 | A1 | 2/2004 | Moeller et al. |
| 2004/0195484 | A1 | 10/2004 | Sheeran |
| 2004/0251392 | A1* | 12/2004 | Franks, Jr. ..... 248/497 |
| 2005/0161570 | A1* | 7/2005 | Bauerly ..... 248/317 |
| 2005/0208848 | A1 | 9/2005 | Grossman |
| 2005/0257867 | A1 | 11/2005 | Vazin |
| 2006/0048343 | A1 | 3/2006 | Sinon |
| 2006/0090302 | A1 | 5/2006 | Colby |
| 2006/0108497 | A1* | 5/2006 | Miranda ..... 248/690 |
| 2006/0278311 | A1 | 12/2006 | Mittelstaedt |
| 2008/0012706 | A1 | 1/2008 | Mak-Fan |
| 2008/0042032 | A1* | 2/2008 | Yap et al. ..... 248/304 |
| 2010/0071171 | A1 | 3/2010 | Stein |
| 2010/0078541 | A1* | 4/2010 | Fathi et al. ..... 248/339 |
| 2012/0080469 | A1 | 4/2012 | Souders |
| 2014/0084035 | A1 | 3/2014 | Georges |

FOREIGN PATENT DOCUMENTS

| | | | |
|---|---|---|---|
| CN | 2357549 | Y | 1/2000 |
| CN | 2571212 | Y | 9/2003 |
| CN | 2706037 | Y | 6/2005 |
| CN | 2877013 | Y | 3/2007 |
| CN | 200990920 | Y | 12/2007 |
| CN | 201015872 | Y | 2/2008 |
| CN | 201355822 | Y | 12/2009 |
| DE | 20 2004 015 919 | U1 | 3/2005 |
| DE | 10 2008 032 303 | A1 | 1/2010 |
| EP | 0 723 831 | A1 | 7/1996 |
| EP | 1 486 280 | A1 | 12/2004 |
| EP | 1 731 990 | A2 | 12/2006 |
| FR | 2606258 | A1 | 5/1988 |
| FR | 2 931 405 | A1 | 11/2009 |
| GB | 309395 | | 1/1928 |
| GB | 2180137 | A | 3/1987 |
| GB | 2274236 | A | 7/1994 |
| GB | 227 5173 | A | 8/1994 |
| GB | 2 452 098 | A | 2/2009 |
| GB | 2 457 169 | A | 8/2009 |
| GR | 1006621 | | 12/2009 |
| JP | 2003 174913 | A | 6/2007 |
| KR | 20-0434896 | Y1 | 12/2006 |
| KR | 10-0741718 | B1 | 3/2007 |
| KR | 20-2008-0001797 | | 6/2008 |
| KR | 20-2008-0004605 | | 10/2008 |
| NL | 1032954 | | 8/2008 |
| WO | WO 2010/004399 | A1 | 1/2010 |

OTHER PUBLICATIONS

U.S. Appl. No. 29/260,084, filed May 17, 2006, Stein, Sandra.

U.S. Appl. No. 11/977,891, filed Oct. 26, 2007, Stein, Sandra.

Mississippi Quarter from the United States Mint, issued 2002.

Office Action, dated Oct. 23, 2006, for U.S. Appl. No. 10/919,494.

Office Action, dated Sep. 10, 2007, for U.S. Appl. No. 10/919,494.

Office Action, dated Feb. 21, 2007, for U.S. Appl. No. 10/919,494.

Attorneys for Defendant Charm Zone, Inc., "Charm Zone, Inc.'s Motion to Amend Answer; Opposition to Plaintiff's Motion for Judgment on the Pleadings Re: Affirmative Defense of Inequitable Conduct; and Opposition to Motion to Quash Deposition," Document 46 dated Apr. 23, 2010, in United States District Court Northern District of California Case No. CV 09-3623 CRB.

Attorney for Defendant Charm Zone, Inc., "Declaration of Robert P. Andris in Support of Charm Zone, Inc.'s Motion to Amend Answer; Opposition to Plaintiff's Motion for Judgment on the Pleadings Re: Affirmative Defense of Inequitable Conduct; Opposition to Motion to Quash Deposition," Document 46-1 dated Apr. 23, 2010, in United States District Court Northern District of California Case No. CV 09-3623 CRB.

(56) References Cited

OTHER PUBLICATIONS

Attorneys for Defendant Charm Zone, Inc., "Exhibit A, Charm Zone, Inc.'s Amendment to Answer to Complaint F.R.C.P. Rule 15(a)," Document 46-2 dated Apr. 23, 2010, in United States District Court Northern District of California Case No. CV 09-3623 CRB.

Counsel for Plaintiff Alexx, Inc., "Reply in Support of Motion for Judgment on the Pleadings; Motion to Quash," Document 47 datedApr. 26, 2010, in United States District Court Northern District of California Case No. CV 09-3623 CRB.

Attorney for Plaintiff Alexx, Inc., "Notice of Withdrawal of Motion for Judgment on the Pleadings; Motion to Quash," Document 50 dated Apr. 29, 2010, in United States District Court Northern District of California Case No. CV 09-3623 CRB.

Attorneys for Plaintiff Alexx, Inc., "Amended Stipulation and Order Re: Dismissal with Prejudice of Defendant Charm Zone, Inc.," Document 88 dated Jul. 23, 2010, in United States District Court Northern District of California Casc No. CV 09-3623 CRB.

* cited by examiner

KEY LOCATOR WITH A CONTAINER

CROSS REFERENCE TO RELATED APPLICATIONS

This application is a continuation-in-part of U.S. patent application Ser. No. 12/468,012, filed May 18, 2009, now U.S. Pat. No. 8,672,002 which is a continuation of U.S. Pat. Appl. No. 11/977,891, filed Oct. 26, 2007 now U.S. Pat. No. 7,537,032, which is a continuation of U.S. Pat. Appl. No. 10/919,494, filed on Aug. 17, 2004 now U.S. Pat. No. 7,308, 922.

FIELD OF THE DISCLOSURE

The present disclosure relates to key locators. More particularly, this disclosure pertains to key locators that are especially adapted to facilitate the ready location of keys in a purse, backpack, briefcase or like bag.

BACKGROUND

A common and popular type of purse or like bag has a top that includes at least a region that is upwardly open in use. Often this type of bag is rather deep, permitting the owner-user to store a variety of items. Further, such depth is generally considered fashionable. A known drawback of the above-described purse or like bag configuration resides in the difficulty of readily retrieving keys, or a group thereof gathered on a key chain, from its interior. This can lead to the frustration of the owner-user and to others. For example, the difficulty of locating car keys at the bottom of a purse can cause significant delay in vacating a parking space.

Given the above importance of the above identified objectives, what are needed in the art are improved apparatus for holding and storing keys and similar items when transporting them in purses or other bags.

SUMMARY

The present disclosure addresses the preceding and other shortcomings of the prior art by providing a key locator. Such a key locator includes a first member having opposed end portions.

The member incorporates a bent interior region intermediate the end portions. A second member includes a clasp for selectively retaining at least one key. The first and second members are engaged to one another.

The preceding and other features of the invention will become further apparent from the detailed description that follows. Such description is accompanied by a set of drawing figures. Numerals of the drawing figures correspond to numerals of the written description with like numerals referring to like features throughout both the written description and the drawing figures.

BRIEF DESCRIPTION OF THE DRAWINGS

Like reference numerals refer to corresponding parts throughout the several views of the drawings.

DETAILED DESCRIPTION

First Embodiment

Figure 1A:
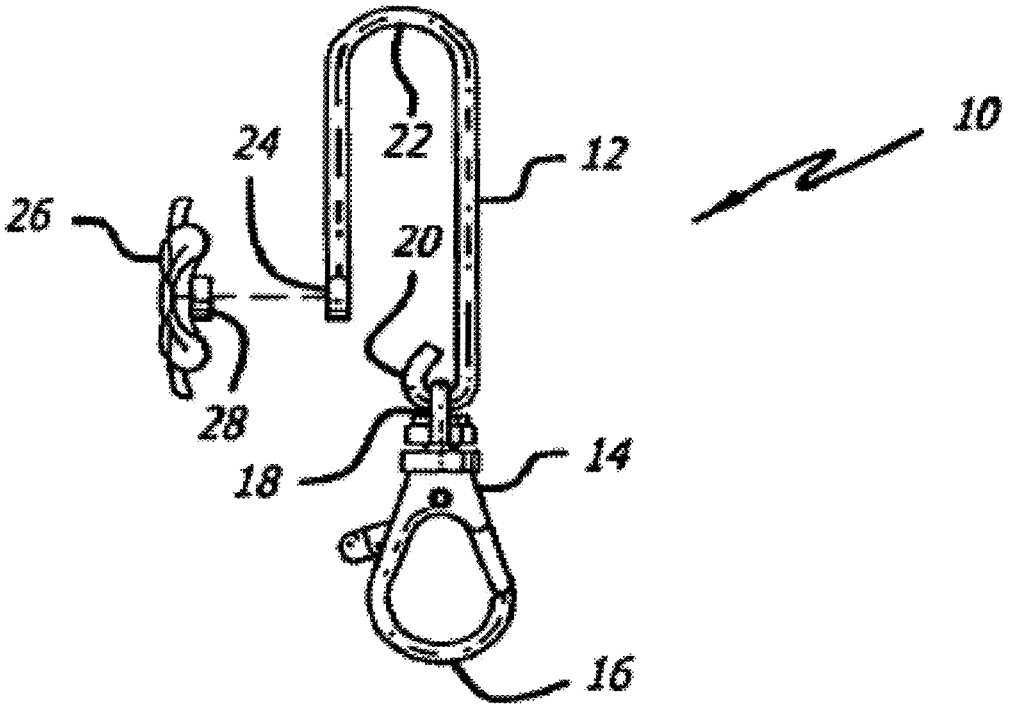
FIGS. 1A and 1B are a front elevation view of a key locator in accordance with an embodiment of the disclosure and a partial planar view of the ornament mounting pad thereof respectively.

Turning now to the drawings, FIG. 1A is a front elevation view of the key locator 10 of the invention. The key locator 10 comprises interlocking first and second members 12 and 14 respectively. In some embodiments the first member 12 and the second members 14 are each independently made of steel, or other metal, a plastic, or other rigid elastomeric material. In some embodiments, the first member 12 and the second member 14 each independently comprise gold, silver, steel, nickel, aluminum, an alloy thereof, or any combination thereof. In some embodiments, the first member 12 and the second member 14 are each made of metal. In some embodiments, the first member 12 and/or the second member 14 comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene. In some embodiments, all or a portion of the bent-rod shaped first member 12 is electroplated.

In the embodiment shown in FIG. 1A, the second member 14 includes a clasp 16 that, in some embodiments, is rotatably engaged to an inverted u-shaped element 18. It will be appreciated that clasp 16 is an exemplary way to retain keys. For example, in some alternative embodiments, rather than a clasp 16, a key ring is used in the place of clasp 16. In the embodiment illustrated in FIG. 1A, the u-shaped element 18 is arranged to engage a hook 20 at a first end portion of the first member 12 in order to provide flexible engagement of the members 12 and 14. One of skill in the art will appreciate that there are numerous other methods by which members 12 and 14 can be flexibly engaged. For example, there can be a ring (not shown in FIG. 1) at the first end portion of the first member 12 that engages both hook 20 and u-shaped element 18. In another example, there can be a set of interlocking rings where a first ring in the set of interlocking rings engages hook 20 whereas a second ring in the set of interlocking rings engages u-shaped element 18. The first and second ring may interlock or there may be any number of interlocking rings between the first and second ring. In still another example, there can be a closed form element (not shown) that engages both hook 20 and u-shaped element 18. The closed form element may indeed be the shape of a ring or some other symmetrical shape such as an oval but the disclosure is not so limited. Any closed form shape, such as a polygon, star-shape, or the like can be used to interlock hook 20 to u-shaped element 18. In still another example, there can be a set of interlocking closed form elements where a first closed form element in the set of interlocking closed form elements engages hook 20 whereas a second closed form element in the set of interlocking closed form elements engages u-shaped element 18. The first and second closed form elements may interlock or there may be any number of interlocking closed form elements between the first and second closed form element. In some embodiments, a chain is used to interlock u-shaped element 18 to hook 20.

It will be appreciated that hook 20 is just one example of a way to flexibly engage members 12 and 14. For example, hook 20 can be completely closed off so that it is, in of itself, in fact a closed form shape such as a ring or oval. Similarly, it will be appreciated that u-shaped element 18 is just one example of a way to flexibly engage members 12 and 14. For example, rather than having a u-shaped element 18, a pivoting element can be used to flexibly engage members 12 and 14.

Figure 1B:
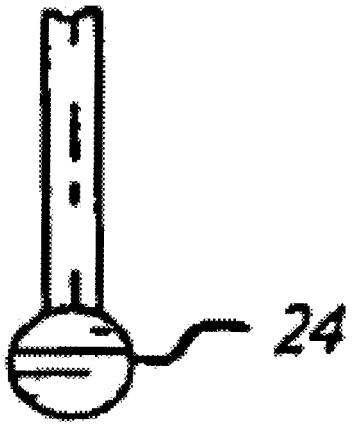
Figure 1C:
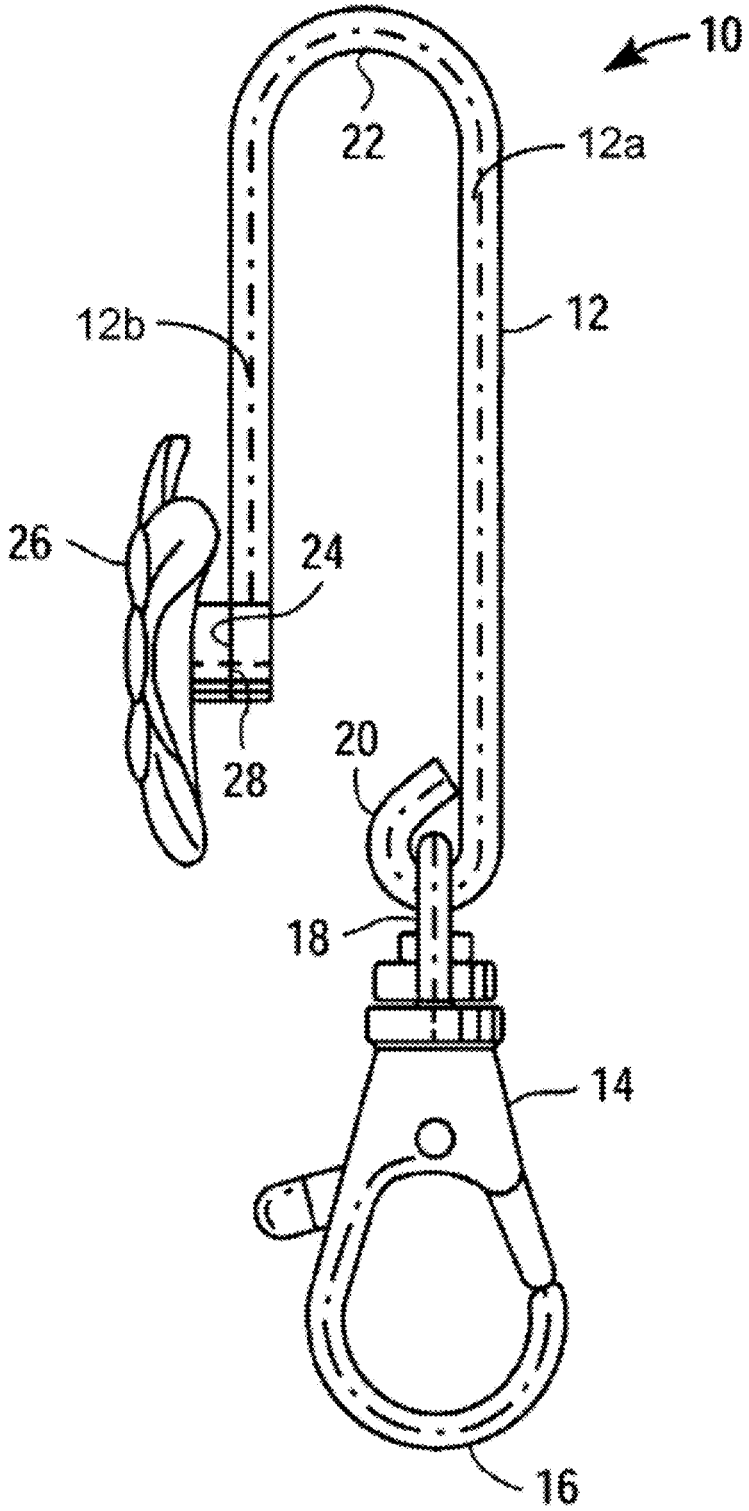
FIG. 1C is a front elevation view of the key locator with the decorative element shown attached.

In one aspect, referring to FIG. 1C, a first end portion 12*a* of the first member 12 comprises a hook 20 for substantially permanently and flexibly engaging with the second member 14. The second member 14 comprises a closed form clasp 16 or ring (not shown) that is configured for selectively retaining at least one key or other type of object. In one such embodiment, the closed form clasp 16 or ring is rotatably fixed to a u-shaped element 18 of the second member 14, where the u-shaped element 18 is substantially permanently and flexibly engaged with the hook 20. In another such embodiment (not illustrated), the closed form clasp 16 or ring is substantially permanently and flexibly engaged with the hook 20. In another such embodiment, the closed form clasp 16 or ring is engaged with a closed form member, where the closed form member is substantially permanently and flexibly engaged with the hook. This closed form member could be, for example, a ring, an oval, a start shape, or any other closed form shape. In another such embodiment (not shown), the closed form clasp 16 or ring is engaged with a closed form member, where the closed form member is a ring that is substantially permanently and flexibly engaged with the hook 20. In still another such embodiment (not shown), the closed form clasp 16 or second ring is engaged with a chain, where the chain is substantially permanently and flexibly engaged with the hook. In yet another such embodiment (not shown), the closed form clasp 16 or second ring is engaged with first interlocking closed form elements in a plurality of interlocking closed form elements, where an interlocking closed form element in the plurality of interlocking closed form elements is substantially permanently and flexibly engaged with the hook. In some such embodiments, a closed form element in the plurality of closed form elements is a ring, an oval, a polygon, or a star-shape.

Figure 7:
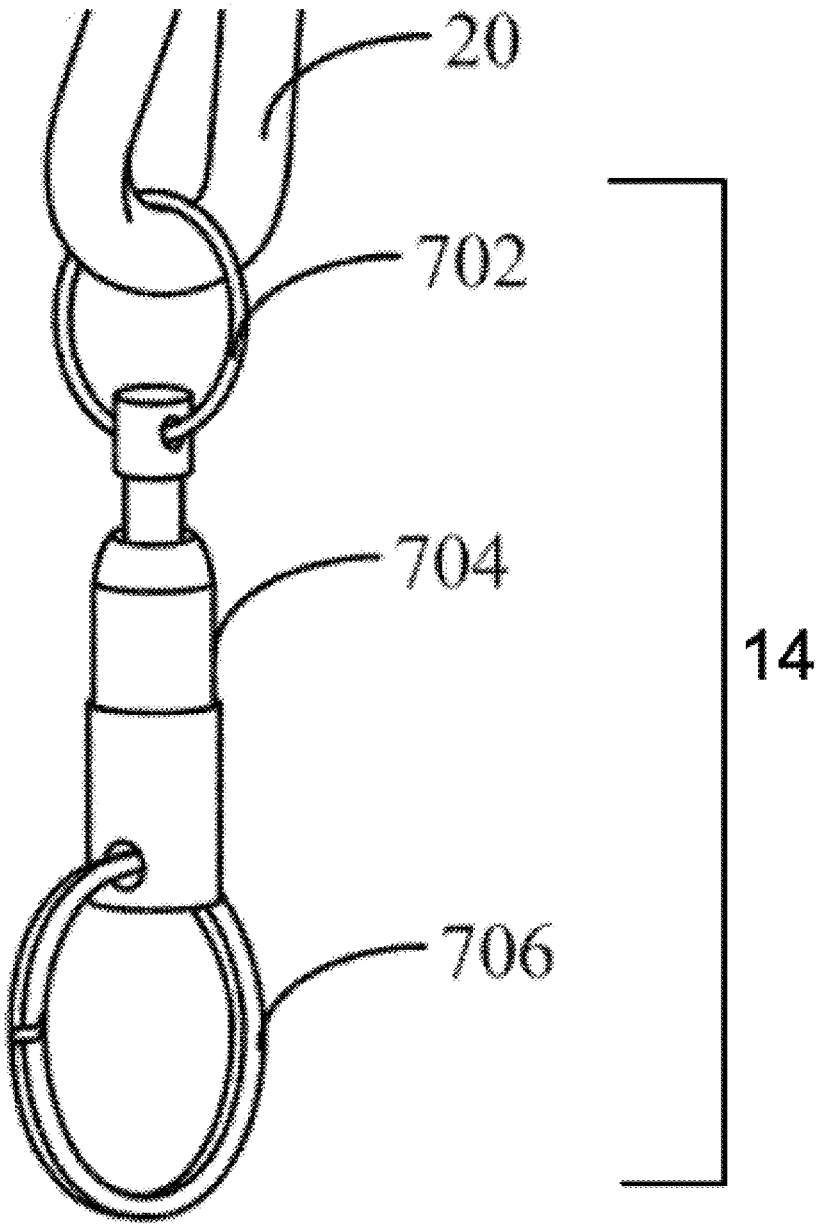
FIG. 7 illustrates more details of a second member of a key locator in accordance with an embodiment of the present disclosure.
Figure 8:
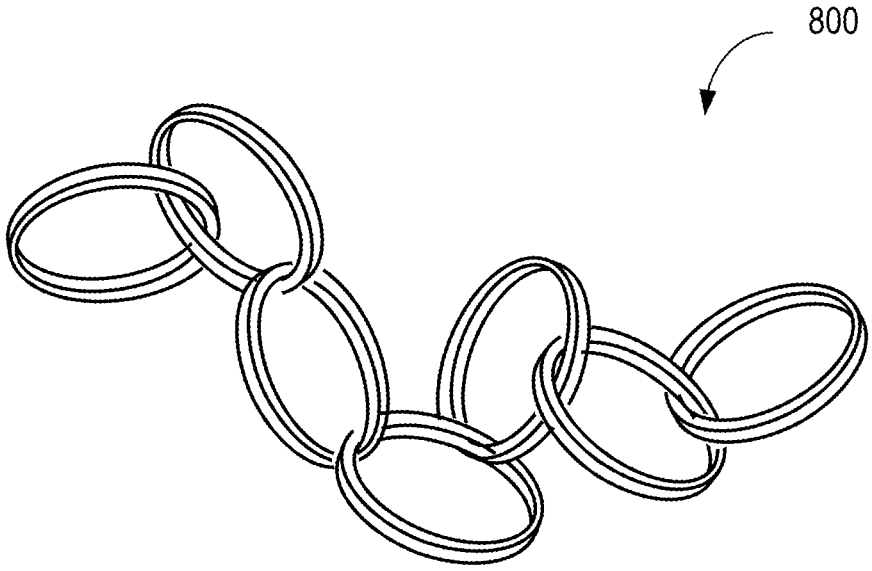
Figure 9A:
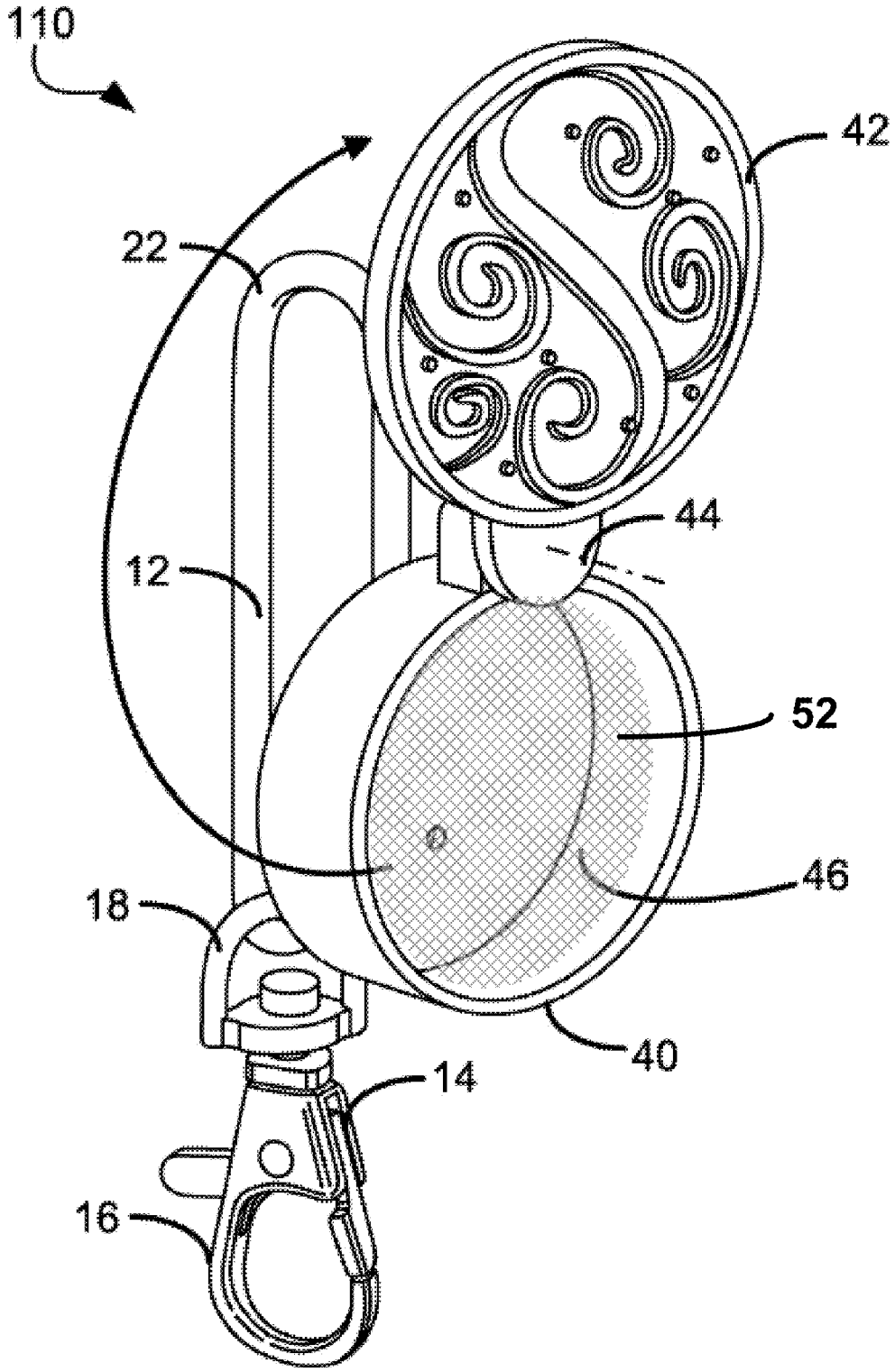
Figure 9B:
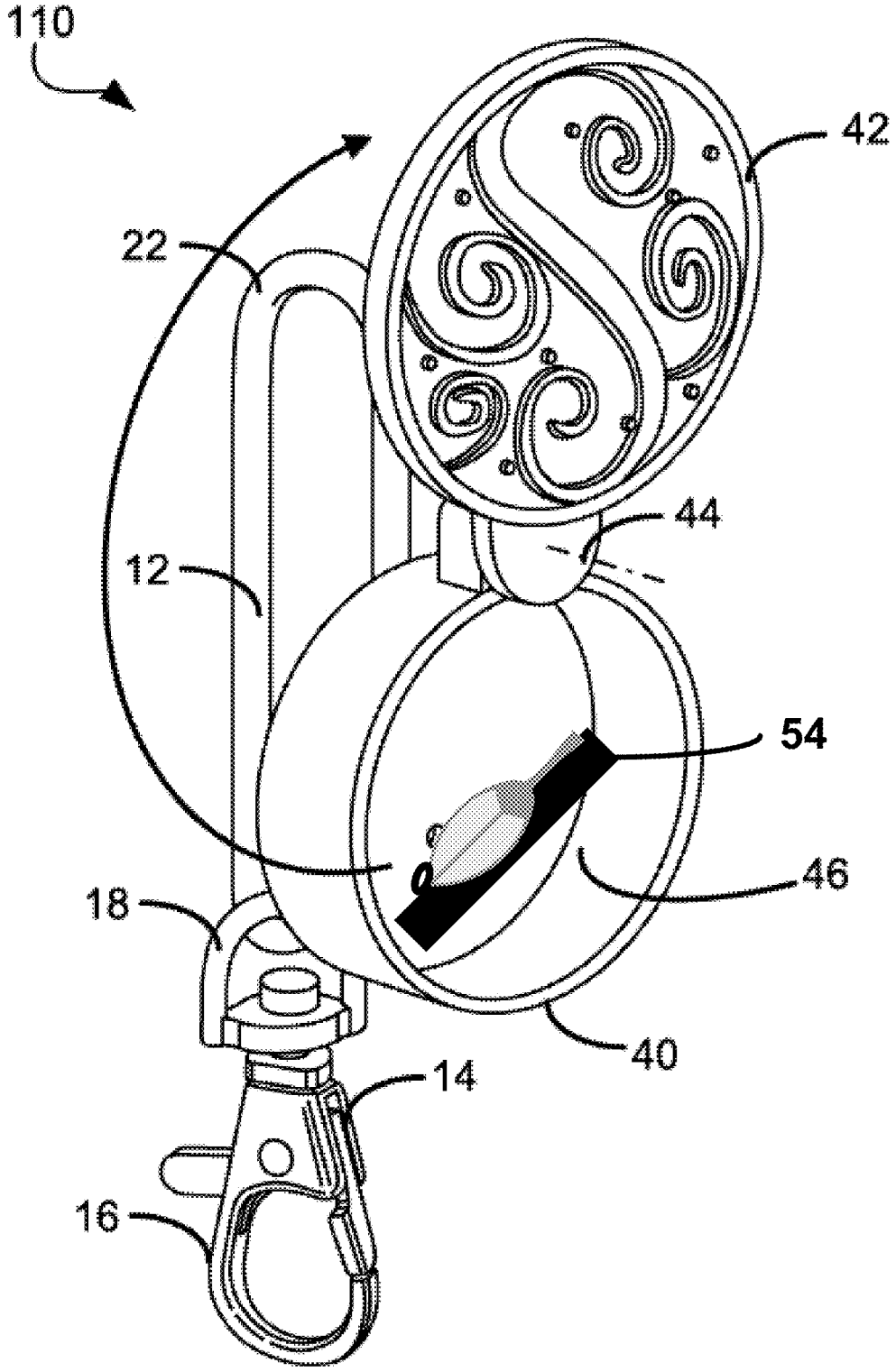
Figure 10A:
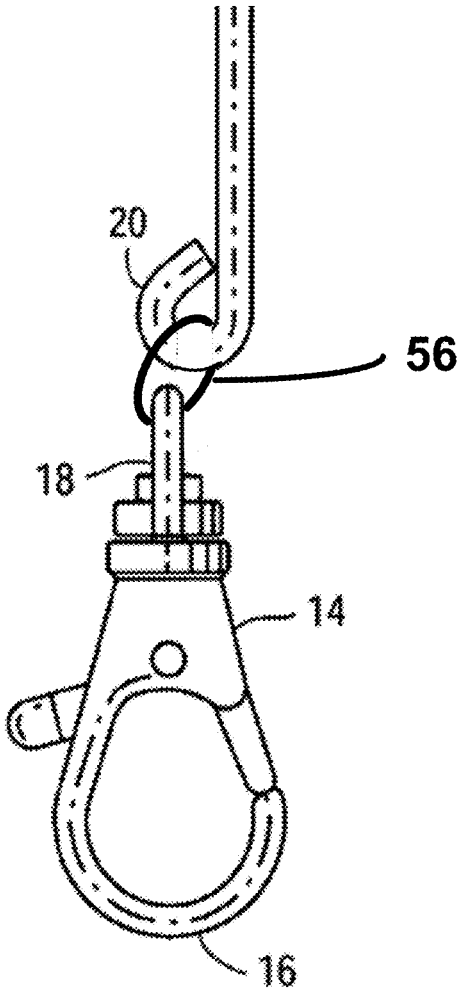
Figure 10B:
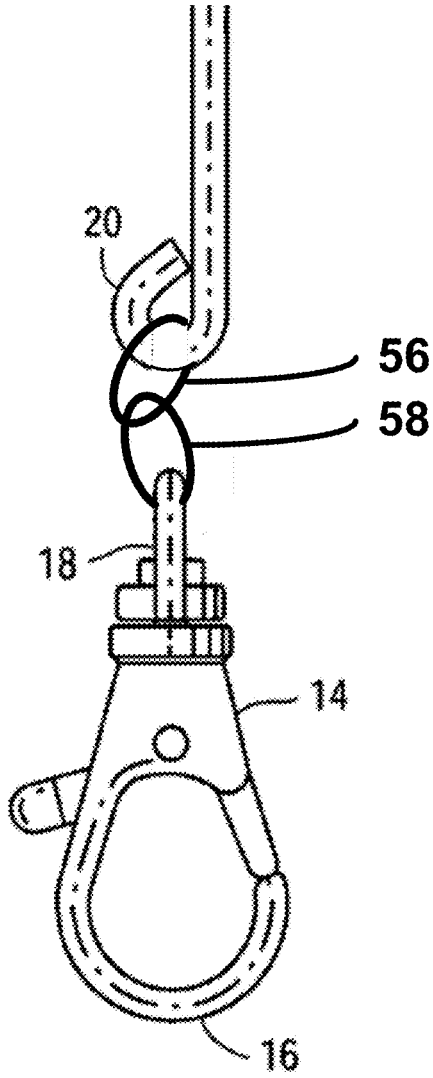

Referring to FIG. 7, in some embodiments the first end portion 12*a* of the bent rod-shaped first member 12 comprises a hook 20 for substantially permanently and flexibly engaging with the second member 14. The second member of the key locator 10 further comprises a first ring 702 that is hooked onto the hook 20. The second member of the key locator 10 further comprises a member 704 having a first portion and a second portion. The first portion is rotatable with respect to the second portion. The first portion comprises a first eyelet through which the first ring 702 is attached. The second portion comprises a second eyelet. The second member 14 of the key locator 10 further comprises a second ring 706 that is attached to the second eyelet.

Similar to FIG. 7, although not depicted, in some embodiments, the first end portion 12*a* of the bent rod-shaped first member 12 comprises a first ring for substantially permanently and flexibly engaging with the second member 14. The second member 14 of the key locator 10 further comprises a second ring that is hooked onto the first ring. The second member 14 of the key locator 10 further comprises a member having a first portion and a second portion. The first portion is rotatable with respect to the second portion. The first portion comprises a first eyelet through which the second ring is attached. The second portion comprises a second eyelet. The second member 14 of the key locator 10 further comprises a third ring, where the third ring is attached to the second eyelet.

In another aspect, a first end portion 12*a* of the first member 12 comprises a first ring (not shown) for substantially permanently and flexibly engaging with the second member 14. The second member 14 comprises a closed form clasp 16 or second ring (not shown) that is configured for selectively retaining at least one key or other type of object. In one such embodiment, the closed form clasp 16 or second ring is rotatably fixed to a u-shaped element 18 of the second member 14, where the u-shaped element 18 is substantially permanently and flexibly engaged with the first ring. In another such embodiment, the closed form clasp 16 or second ring is substantially permanently and flexibly engaged with the first ring. In another such embodiment, the closed form clasp 16 or second ring is engaged with a closed form member, where the closed form member is substantially permanently and flexibly engaged with the first ring. In still another such embodiment, the closed form clasp 16 or second ring is engaged with a closed form member, where the closed form member is a third ring that is substantially permanently and flexibly engaged with the first ring. In still another such embodiment, the closed form clasp 16 or second ring is engaged with a chain, where the chain is substantially permanently and flexibly engaged with the first ring. In still another such embodiment, the closed form clasp or second ring is engaged with a first interlocking closed form element in a plurality of interlocking closed form elements, where a second interlocking closed form element in the plurality of interlocking closed form elements is substantially permanently and flexibly engaged with the first ring.

Referring to FIG. 1C, the first member 12 includes a bent interior region 22. In some embodiments, a second end portion 12*b* of the first member 12 comprises an enlarged region 24 that serves as an ornament mounting pad for affixation of a decorative ornament 26. In some embodiments, there is no enlarged region 24 and the decorative ornament 26 is affixed directly onto the second end portion 12*b* of the first member 12.

Figure 2:
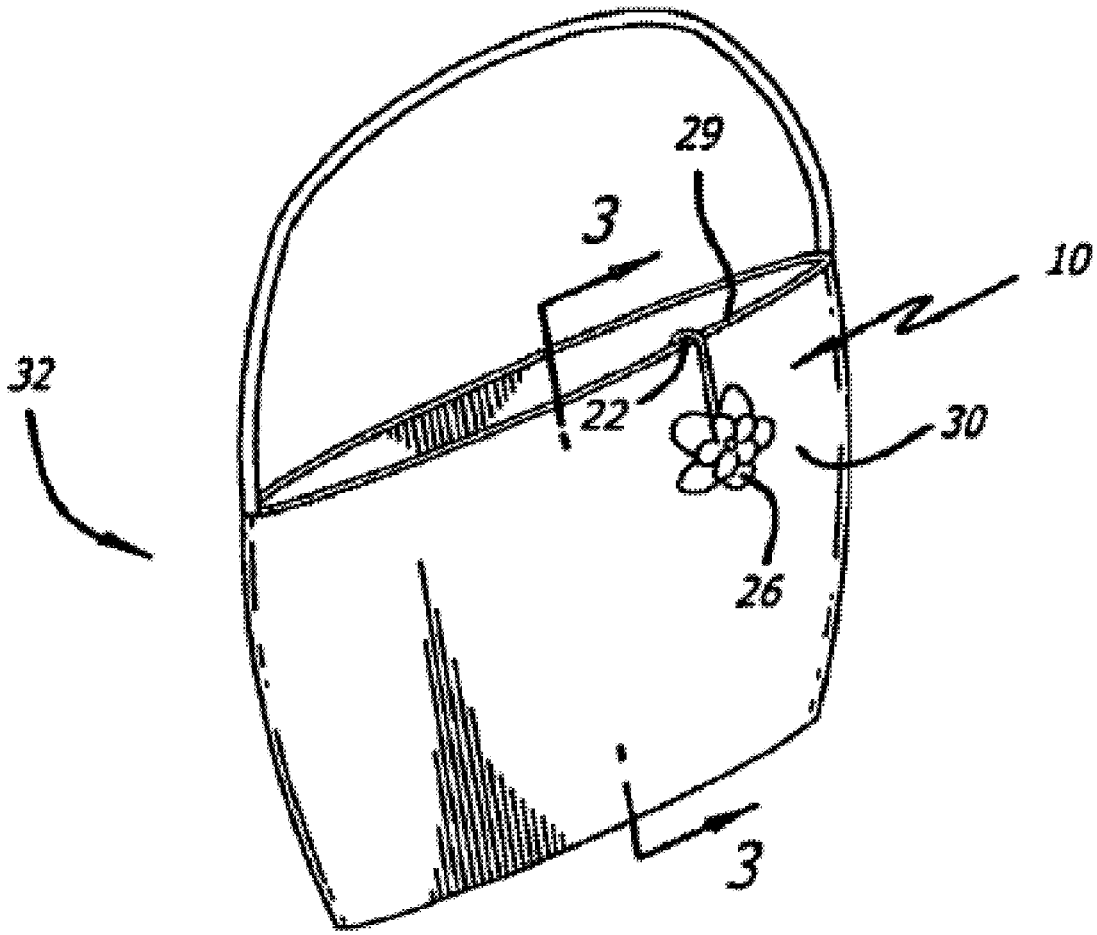
FIG. 2 is a perspective view of the key locator of FIGS. 1A through 1C in use.
Figure 3:
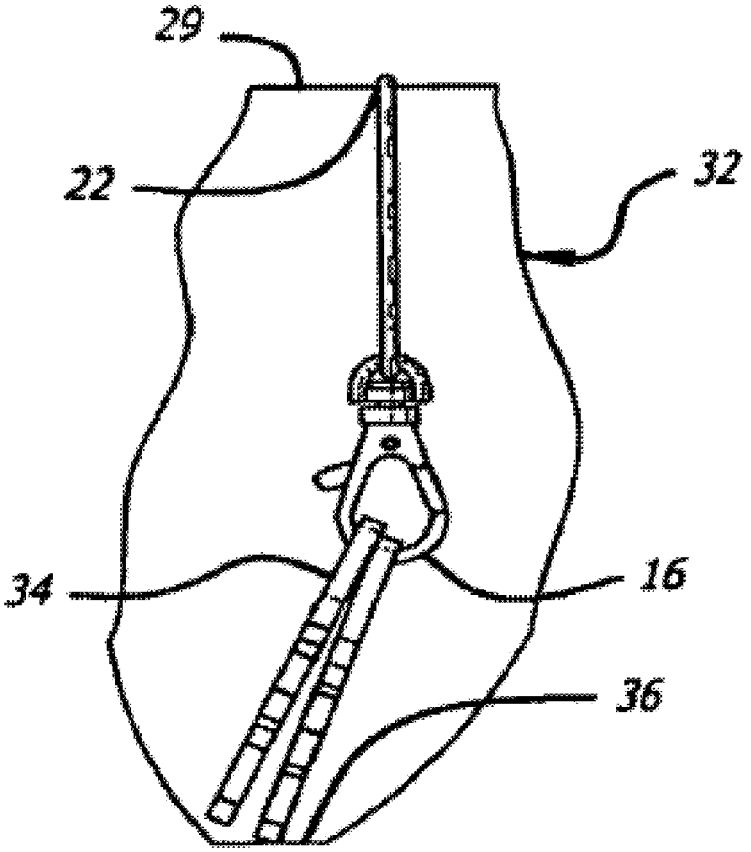
FIG. 3 is a cross-sectional view of the key locator in use taken at line 3-3 of FIG. 2.

As illustrated in FIGS. 1C, 2 and 3, the first member 12 has a first end portion 12*a* and a second end portion 12*b*. The first end portion 12*a* of the first member 12 is configured for substantially permanently and flexibly engaging with the second member 14. The second end portion 12*b* of the first member 12 is configured for affixation of an ornament 26 so that, when affixed to the key locator 10, the entire ornament is 26 substantially rigidly affixed to the key locator 10 such that any movement of the ornament 26 necessarily causes movement of the key locator 10. The first end portion 12*a* and the second end portion 12*b* of the first member 12 are not urged against each other and are configured to allow the bent interior region 22 to hang or clasp an edge 29. In some embodiments, the first end portion 12*a* and the second end portion

12*b* of the first member 12 are configured so that a force of between 1 dyne and 2000 dynes is required to remove the key locator 10 from an edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 1000 dynes is required to remove the key locator 10 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 500 dynes is required to remove the key locator 10 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 250 dynes is required to remove the key locator 10 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 2000 dynes is required to remove the key locator 10 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 1000 dynes is required to remove the key locator 10 from the edge 29 of a bag-like purse 32 at a time when said bent interior region 22 hangs from or clasps the edge 29. In some embodiments, the first end portion 12*a* and the second end portion 12*b* of the first member are configured so that a force of between 100 dynes and 500 dynes is required to remove the key locator 10 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 250 dynes is required to remove the key locator 10 from the edge 29 of a bag-like purse 32 at a time when the bent interior region 22 hangs from or clasps the edge 29.

In some embodiments, the first end portion 12*a* and the second end portion 12*b* of the first member 12 are configured so that a force of between 1 dyne and 2000 dynes, between 1 dyne and 1000 dynes, between 1 dyne and 500 dynes, between 1 dyne and 250 dynes, between 0.1 dynes and 2000 dynes, between 0.1 dynes and 1000 dynes, between 0.1 dynes and 500 dynes, between 0.1 dynes and 250 dynes, between 100 dynes and 2000 dynes, between 100 dynes and 1000 dynes, between 100 dynes and 500 dynes, between 100 dynes and 250 dynes, between 500 dynes and 5000 dynes, between 500 dynes and 10000 dynes, between 500 dynes and 20000 dynes, between 500 dynes and 25000 dynes, between 0.1 dynes and 200 dynes, between 0.1 dynes and 100 dynes, between 0.1 dynes and 50 dynes, or between 0.1 dynes and 25 dynes is required to remove the key locator 10 from the edge 29 of a bag-like purse 32 at a time when the bent interior region 22 hangs from or clasps the edge 29.

The ornament 26, comprising a flower-like shape as shown in the drawings but not limited thereto, is arranged to face away from the interior of the first member 12 with its back portion 28 preferably fixed to the enlarged region 24 of the member by solder or the like. In some embodiments that do not have an enlarged region 24, the back portion 28 is affixed directly onto the end portion of the first member. As used herein, an ornament is a solid object as opposed to a chain or a rope. In some embodiments, the ornament comprises an artificial or a real gem.

FIG. 2 is a perspective view of the key locator 10 of the invention in use. In FIG. 2, the key locator 10 is hung from the upper edge 29 of a side panel 30 of a bag-like purse 32 with the bent interior region 22 overhanging the side panel 30 so that the face of the ornament 26 is exposed. In other embodiments (not shown), the key locator 10 clasps the upper edge 29 of a side panel 30 of a bag-like purse 32 with the bent interior region 22 overhanging the side panel 30 so that the face of the ornament 26 is exposed. The foregoing provides the user with an attractive adjunct to the bag-like purse 32 that serves the additional function of readily locating the key locator 10.

FIG. 3 is a cross-sectional view of the key locator 10 of the disclosure in use taken at line 3-3 of FIG. 2. Keys or other objects 34, secured by the clasp 16 of the second member 14, are seen to lie near or at the bottom 36 of the bag-like purse 32, somewhat suspended from the upper edge 29 of the side panel 30. The bent interior region 22 of the first member 12 of the key locator 10, as mentioned with reference to the preceding figure, is draped, hung over or clasped to the upper edge 29 to create the suspension effect. The altitude of the bottom of the key locator 10 and keys 34 will depend upon the length of the key locator 10 relative to the depth of the side panel 30 of the bag-like purse 32. However, regardless of the precise altitude of the keys 34 within the bag-like purse 32, they may be readily located due to the visible presence of the ornament 26.

In FIG. 1, first member 12 has a rod-like appearance. That is, first member 12 is slender so that it can be easily gripped and removed from a bag-like container such as a purse. There is no requirement that first member 12 have the cylindrical shape depicted in FIG. 1. Any slender shape form that enables the easy removal of key locator 10 from a bag-like purse is within the scope of the present disclosure. For example, first member 12 can be a flattened wire or other flat elements. In another example, in some embodiments, first member 12 has a flat rod-like shape characterized by a cross-section having first and second orthogonal dimensions in which the first dimension defines the thickness of the first member 12 and is between 0.01 cm and 0.5 cm and the second dimension defines the width of the first member 12 and is between 0.1 cm and 2 cm. In another example, in some embodiments, first member 12 has a flat rod-like shape characterized by a cross-section having first and second orthogonal dimensions in which the first dimension defines the thickness of the first member 12 and is between 0.05 cm and 0.8 cm and the second dimension defines the width of the first member 12 and is between 0.2 cm and 3 cm.

In some embodiments, the bent interior region 22 is u-shaped. In some embodiments, the bent rod-shaped first member 12 is characterized by a cross-sectional bounding shape that is circular. In some embodiments, the bent rod-shaped first member 12 is characterized by a cross-sectional bounding shape that is ovoid. In some embodiments, the bent rod-shaped first member 12 is characterized by a cross-sectional bounding shape having one or more smooth curved surfaces or a splice of one or more smooth curved surfaces. In some embodiments, the bent rod-shaped first member 12 is characterized by a cross-sectional bounding shape having an arcuate edge. In some embodiments, the bent rod-shaped first member 12 is characterized by different cross-sectional bounding shapes at different portions of the first member 12.

Although the figures illustrate the first member in which end portions are parallel to each other and are straight, the present disclosure is not so restricted. The first and second end portions 12*a* and 12*b* of the first member 12 may bend toward or away from each other. Moreover, the first and second end portions of the first member 12 may internally include any number of bends. Moreover, the first and second end portions of the first member 12 may be magnetized and the bent-shaped region may contain a hinge.

Second Embodiment

Figure 4A:
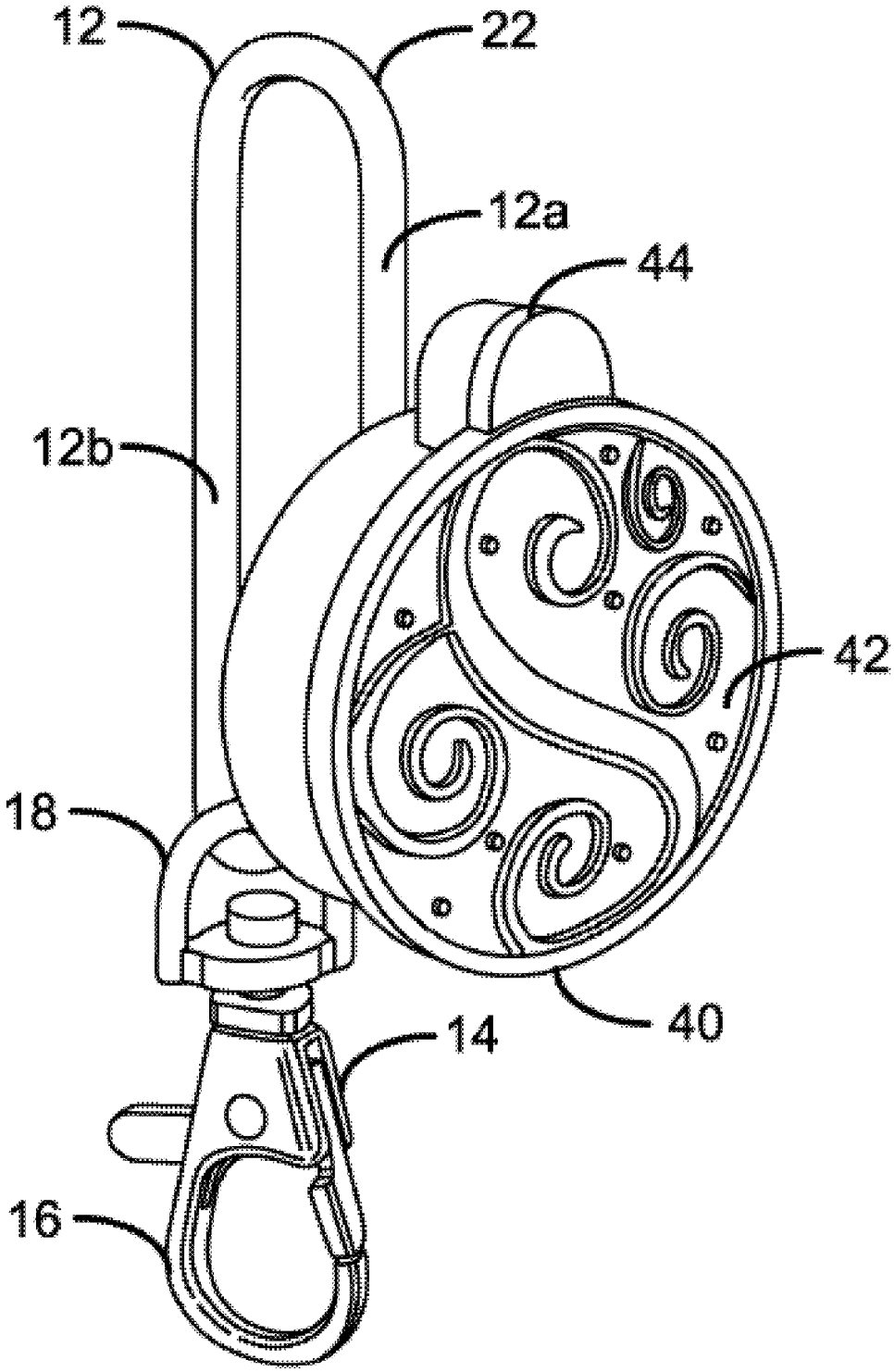
FIG. 4 is a front perspective view of a key locator in accordance with another embodiment of the disclosure in which a container is attached to the key finder.
Figure 4B:
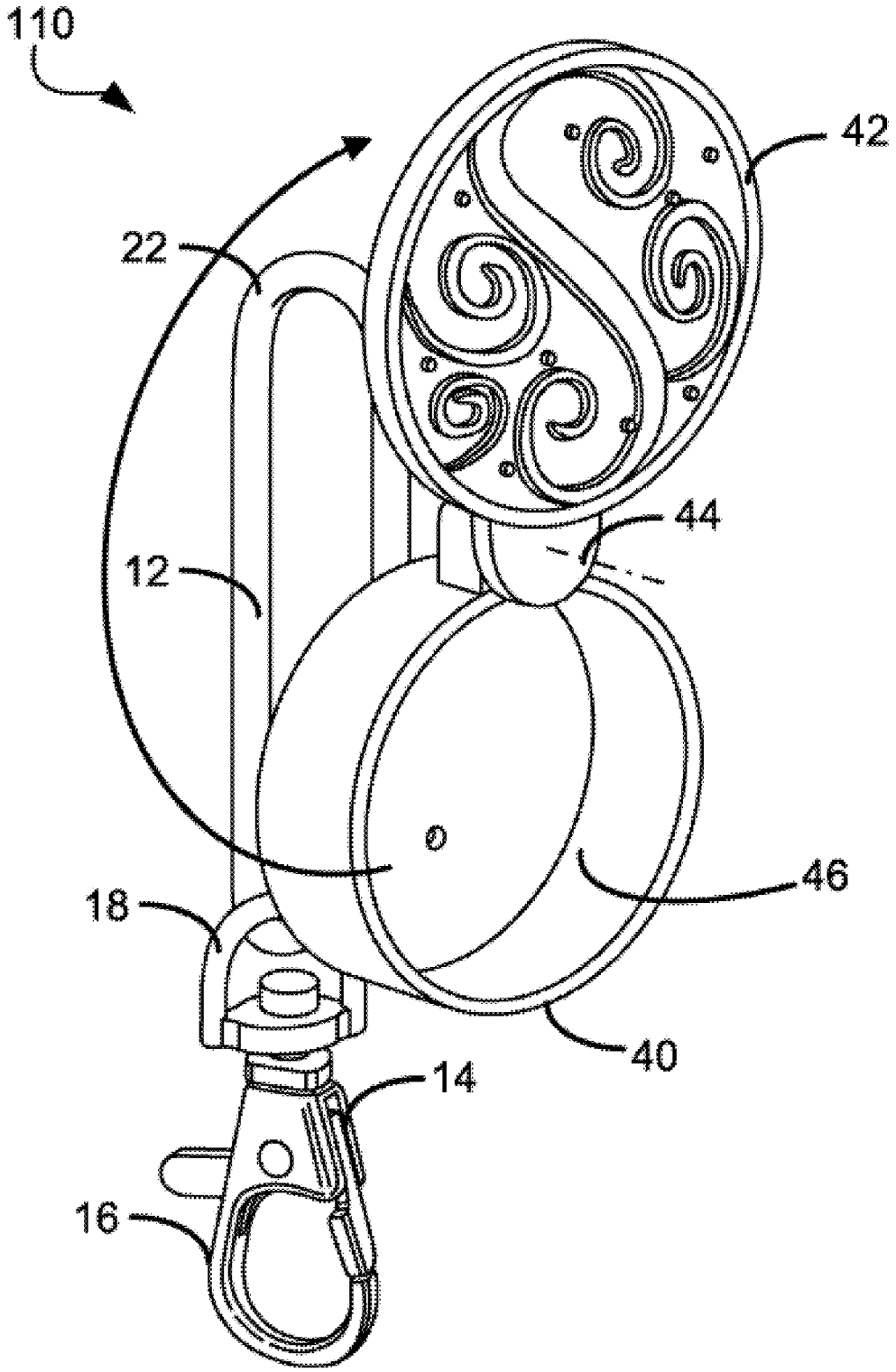

FIG. 4 is a front perspective view of a key locator 110 in accordance with another embodiment of the disclosure in which, rather than having an ornament 26, there is a container 40. As in the case of the key locator 10 discussed above and illustrated in FIGS. 1 through 3, the key locator 110 illustrated in FIGS. 4 through 6 comprises interlocking first and second members 12 and 14. In some embodiments the first member 12 and the second members 14 are each independently made of steel, or other metal, a plastic, or other rigid elastomeric material. In some embodiments, the first member 12 and the second member 14 each independently comprise gold, silver, steel, nickel, aluminum, an alloy thereof, or any combination thereof. In some embodiments, the first member 12 and the second member 14 are each made of metal. In some embodiments, the first member 12 and/or the second member 14 comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene. In some embodiments, all or a portion of the bent-rod shaped first member 12 is electroplated.

In the embodiment illustrated in FIG. 4, the second member 14 includes a clasp 16 that, in some embodiments, is rotatably engaged to an inverted u-shaped element 18. It will be appreciated that clasp 16 is an exemplary way to retain keys. For example, in some alternative embodiments, rather than a clasp 16, a key ring is used in the place of clasp 16. In the embodiment illustrated in Figure, the u-shaped element 18 is arranged to engage a hook 20 at a first end portion of the first member 12 in order to provide flexible engagement of the members 12 and 14. One of skill in the art will appreciate that there are numerous other methods by which members 12 and 14 can be flexibly engaged. For example, there can be a ring (not shown in FIG. 4) at the first end portion of the first member 12 that engages both hook 20 and u-shaped element 18. In another example, there can be a set of interlocking rings where a first ring in the set of interlocking rings engages hook 20 whereas a second ring in the set of interlocking rings engages u-shaped element 18. The first and second ring may interlock or there may be any number of interlocking rings between the first and second ring. In still another example, there can be a closed form element (not shown) that engages both hook 20 and u-shaped element 18. The closed form element may indeed be the shape of a ring or some other symmetrical shape such as an oval but the disclosure is not so limited. Any closed form shape, such as a polygon, star-shape, or the like can be used to interlock hook 20 to u-shaped element 18. In still another example, there can be a set of interlocking closed form elements where a first closed form element in the set of interlocking closed form elements engages hook 20 whereas a second closed form element in the set of interlocking closed form elements engages u-shaped element 18. The first and second closed form elements may interlock or there may be any number of interlocking closed form elements between the first and second closed form element. In some embodiments, a chain is used to interlock u-shaped element 18 to hook 20.

Figure 5:
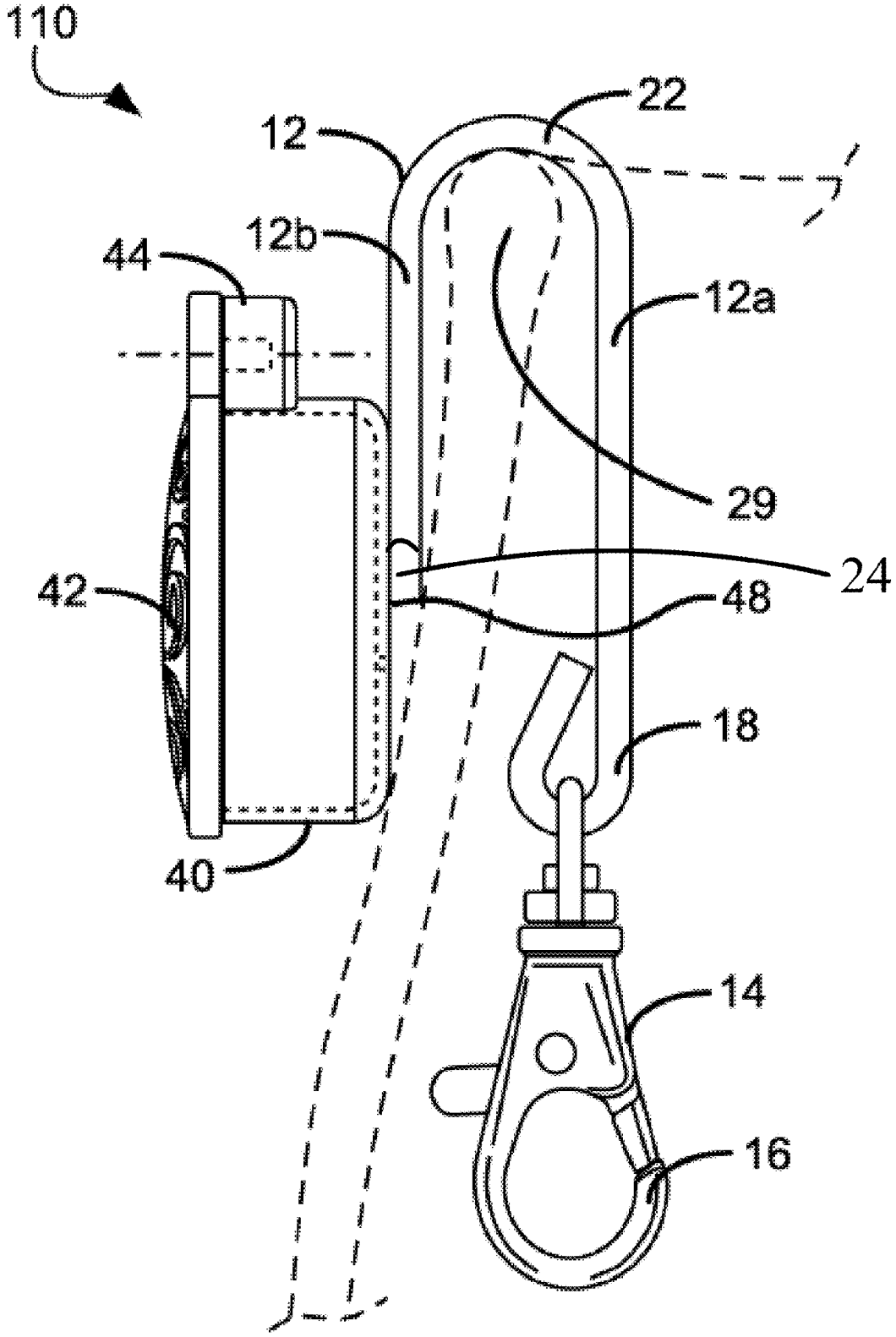
FIG. 5 is a right side perspective view of the key locator depicted in FIG. 4 showing the key locator hanging from an edge of a bag-like purse with the container, where the container comprises a hinge that attaches a first face to the container, and where the first face is configured to be in a closed configuration that seals an interior portion of the container.
Figure 6:
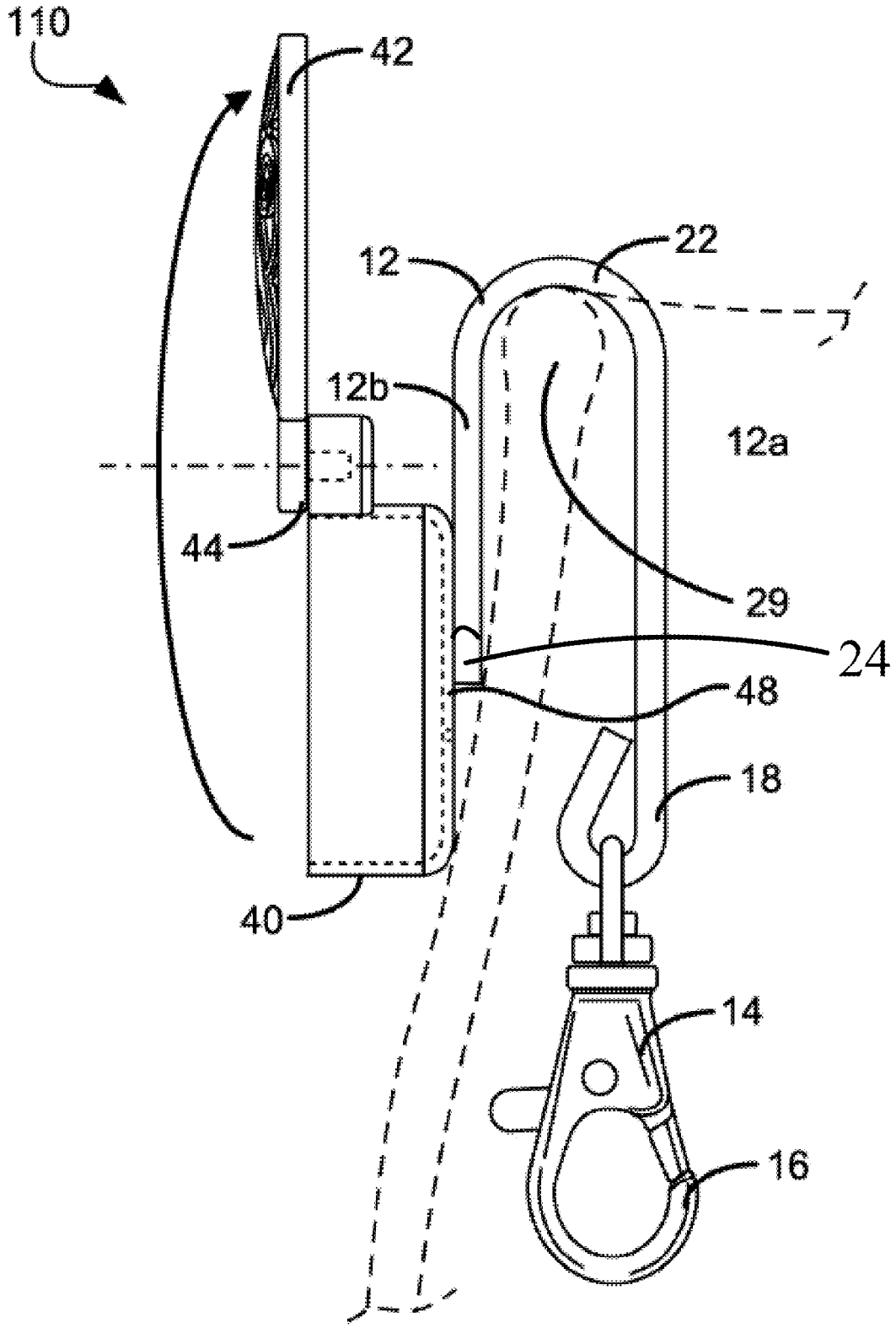
FIG. 6 is a left side perspective view of the key locator depicted in FIG. 4 showing the key locator hanging from an edge of a bag-like purse with the container, where the container comprises a hinge that attaches a first face to the container, and where the first face is configured to be in an open configuration that exposes an interior portion of the container.

It will be appreciated that hook 20 is just one example of a way to flexibly engage members 12 and 14 in the embodiment of the key locator 110 illustrated in FIGS. 4 through 6. For example, hook 20 can be completely closed off so that it is, in of itself, in fact a closed form shape such as a ring or oval. Similarly, it will be appreciated that u-shaped element 18 is just one example of a way to flexibly engage members 12 and 14. For example, rather than having a u-shaped element 18, a pivoting element can be used to flexibly engage members 12 and 14.

In one aspect, referring to FIG. 4, a first end portion 12*a* of the first member 12 comprises a hook 20 for substantially permanently and flexibly engaging with the second member 14. The second member 14 comprises a closed form clasp 16 or ring (not shown) that is configured for selectively retaining at least one key or other type of object. In one such embodiment, the closed form clasp 16 or ring is rotatably fixed to a u-shaped element 18 of the second member 14, where the u-shaped element 18 is substantially permanently and flexibly engaged with the hook 20. In another such embodiment (not illustrated), the closed form clasp 16 or ring is substantially permanently and flexibly engaged with the hook 20. In another such embodiment, the closed form clasp 16 or ring is engaged with a closed form member, where the closed form member is substantially permanently and flexibly engaged with the hook. This closed form member could be, for example, a ring, an oval, a start shape, or any other closed form shape. In another such embodiment (not shown), the closed form clasp 16 or ring is engaged with a closed form member, where the closed form member is a ring that is substantially permanently and flexibly engaged with the hook 20. In still another such embodiment (not shown), the closed form clasp 16 or second ring is engaged with a chain, where the chain is substantially permanently and flexibly engaged with the hook. In yet another such embodiment (not shown), the closed form clasp 16 or second ring is engaged with first interlocking closed form elements in a plurality of interlocking closed form elements, where an interlocking closed form element in the plurality of interlocking closed form elements is substantially permanently and flexibly engaged with the hook. In some such embodiments, a closed form element in the plurality of closed form elements is a ring, an oval, a polygon, or a star-shape.

In another aspect, a first end portion 12*a* of the first member 12 comprises a first ring (not shown) for substantially permanently and flexibly engaging with the second member 14. The second member 14 comprises a closed form clasp 16 or second ring (not shown) that is configured for selectively retaining at least one key or other type of object. In one such embodiment, the closed form clasp 16 or second ring is rotatably fixed to a u-shaped element 18 of the second member 14, where the u-shaped element 18 is substantially permanently and flexibly engaged with the first ring. In another such embodiment, the closed form clasp 16 or second ring is substantially permanently and flexibly engaged with the first ring. In another such embodiment, the closed form clasp 16 or second ring is engaged with a closed form member, where the closed form member is substantially permanently and flexibly engaged with the first ring. In still another such embodiment, the closed form clasp 16 or second ring is engaged with a closed form member, where the closed form member is a third ring that is substantially permanently and flexibly engaged with the first ring. In still another such embodiment, the closed form clasp 16 or second ring is engaged with a chain, where the chain is substantially permanently and flexibly engaged with the first ring. In still another such embodiment, the closed form clasp or second ring is engaged with a first interlocking closed form element in a plurality of interlocking closed form elements, where a second interlocking closed form element in the plurality of interlocking closed form elements is substantially permanently and flexibly engaged with the first ring.

Referring to FIG. 7, in some embodiments the first end portion 12*a* of the bent rod-shaped first member 12 comprises a hook 20 for substantially permanently and flexibly engaging with the second member 14. The second member of the key locator further comprises a first ring 702 that is hooked onto the hook 20. The second member of the key locator 110 further comprises a member 704 having a first portion and a second portion. The first portion is rotatable with respect to the second portion. The first portion comprises a first eyelet through which the first ring 702 is attached. The second portion comprises a second eyelet. The second member 14 of the key locator 110 further comprises a second ring 706 that is attached to the second eyelet.

Similar to FIG. 7, although not depicted, in some embodiments, the first end portion 12*a* of the bent rod-shaped first member 12 comprises a first ring for substantially permanently and flexibly engaging with the second member 14. The second member 14 of the key locator 110 further comprises a second ring that is hooked onto the first ring. The second member 14 of the key locator 110 further comprises a member having a first portion and a second portion. The first portion is rotatable with respect to the second portion. The first portion comprises a first eyelet through which the second ring is attached. The second portion comprises a second eyelet. The second member 14 of the key locator 110 further comprises a third ring, where the third ring is attached to the second eyelet.

As illustrated in FIGS. 5 and 6, the first member 12 has a first end portion 12*a* and a second end portion 12*b*. The first end portion 12*a* of the first member 12 is configured for substantially permanently and flexibly engaging with the second member 14. The second end portion 12*b* of the first member 12 is configured for affixation of a container 40. In the embodiments depicted in FIGS. 4 through 6, when affixed to the key locator 110, the entire container 40 is substantially rigidly affixed to the key locator 110 such that any movement of the container 40 necessarily causes movement of the key locator 110.

Referring to FIGS. 5 and 6, in some embodiments, the container 40 is directly and permanently fixed to the second end portion 12*b* of the bent rod-shaped first member 12 so that a first face 42 of the container is exposed. The container 40 is arranged so that the first face 42 of the container 40 faces away from an interior of the bent rod-shaped first member 12. The interior of the bent rod-shaped first member is defined by the bent interior region between the first end portion 12*a* and the second end portion 12*b*.

In some embodiments, the container 40 comprises a hinge that attaches the first face 42 to the container 40. The first face 42 is configured to move between (i) an open configuration that exposes an interior portion of the container 40, as depicted in FIG. 6, and (ii) a closed configuration that seals the interior portion of the container 40, as depicted in FIG. 5. In some embodiments, the container 40 comprises a swivel hinge 44 that attaches the first face 42 to the container 50. In such embodiments, the first face 42 is configured to slide between (i) an open configuration that exposes an interior portion of the container 40 and (ii) a closed configuration that seals the interior portion of the container 40. In some embodiments, the first face 42 is adorned with an ornament. In some embodiments, the ornament comprises an artificial or a real gem.

In some embodiments, the container 40 comprises a material selected from the group consisting of metal and plastic. In some embodiments, the container comprises gold, silver, steel, nickel, aluminum, an alloy thereof, or any combination thereof. In some embodiments, the container 40 comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene. In some embodiments, the container 40 is configured to store a liquid. In some embodiments, the container 40 is configured to store a gel, such as lip balm. In some embodiments, the container 40 is configured to store an object. In some embodiments, the container 40 is configured to store lip balm, solid perfume, cuticle cream or solid, dry skin salve, breath mints, gum squares, anti chafe solid, hand sanitizer, personal notes, blessings, reminders, money, pills, vitamins, luggage or briefcase keys, personal notes, and/or jewelry.

As illustrated in FIGS. 4 through 6, the first end portion 12*a* and the second end portion 12*b* of the first member 12 are not urged against each other and are configured to allow the bent interior region 22 to hang or clasp an edge 29. In some embodiments, the first end portion 12*a* and the second end portion 12*b* of the first member 12 are configured so that a force of between 1 dyne and 2000 dynes is required to remove the key locator 110 from an edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 1000 dynes is required to remove the key locator 110 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 500 dynes is required to remove the key locator 110 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 1 dyne and 250 dynes is required to remove the key locator 110 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 2000 dynes is required to remove the key locator 110 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 1000 dynes is required to remove the key locator 110 from the edge 29 of a bag-like purse 32 at a time when said bent interior region 22 hangs from or clasps the edge 29. In some embodiments, the first end portion 12*a* and the second end portion 12*b* of the first member are configured so that a force of between 100 dynes and 500 dynes is required to remove the key locator 110 from the edge 29 of a bag-like purse 32 at a time when the bent interior region 22 hangs from or clasps the edge 29. In some embodiments, the first end portion 12*a* and the second end portion 12*b* of the first member 12 are configured so that a force of between 100 dynes and 250 dynes is required to remove the key locator 110 from the edge 29 of a bag-like purse 32 at a time when the bent interior region 22 hangs from or clasps the edge 29.

In some embodiments, the first end portion 12*a* and the second end portion 12*b* of the first member 12 are configured so that a force of between 1 dyne and 2000 dynes, between 1 dyne and 1000 dynes, between 1 dyne and 500 dynes, between 1 dyne and 250 dynes, between 0.1 dynes and 2000 dynes, between 0.1 dynes and 1000 dynes, between 0.1 dynes and 500 dynes, between 0.1 dynes and 250 dynes, between 100 dynes and 2000 dynes, between 100 dynes and 1000 dynes, between 100 dynes and 500 dynes, between 100 dynes and 250 dynes, between 500 dynes and 5000 dynes, between 500 dynes and 10000 dynes, between 500 dynes and 20000 dynes, between 500 dynes and 25000 dynes, between 0.1 dynes and 200 dynes, between 0.1 dynes and 100 dynes, between 0.1 dynes and 50 dynes, or between 0.1 dynes and 25 dynes is required to remove the key locator 110 from the edge 29 of a bag-like purse 32 at a time when the bent interior region 22 hangs from or clasps the edge 29.

Referring to FIGS. 4 through 6, in on aspect, the key locator 110 further comprises the container 40, and the second end portion 12*b* of the bent rod-shaped first member 12 comprises an enlarged portion and a second face 48 of the container is directly and permanently fixed to the enlarged portion. In some embodiments, the enlarged portion comprises a solid face to which a portion of the second face of the container is directly and permanently fixed. In some embodiments, the enlarged portion comprises a solid face to which a portion of the second face 48 is soldered.

In another aspect, the key locator 110 further comprises the container 40. A second face 48 of the container is directly and permanently fixed to the second end portion 12*b* of the bent rod-shaped first member 12.

In another aspect, the key locator 110 further comprises the container 40, and a second face 48 of the container 40 is soldered to the second end portion 12*b* of the bent rod-shaped first member 40.

In still another aspect, the key locator 110 further comprises the container 40 and the container 40 forms a part (e.g., an integral part) of the second end portion 12*b* of the bent rod-shaped first member 12.

FIGS. 3 and 4 are side views of the key locator 110 of the invention in use. In FIGS. 4 and 5, the key locator 110 is hung from the upper edge 29 of a side panel of a bag-like purse with the bent interior region 22 overhanging the upper edge 29 so that the first face 42 of the container 40 is exposed. In other embodiments (not shown), the key locator 110 clasps the upper edge 29 of a bag-like purse with the bent interior region 22 overhanging the side panel 30 so that the first face 42 of the container 40 is exposed.

FIGS. 5 and 6 are side views of the key locator 110. Keys or other objects, secured by the clasp 16 of the second member 14, may lie near or at the bottom of a bag-like purse, somewhat suspended from the upper edge 29, in the same manner as that depicted in the key locator 10 illustrated in FIG. 3. The bent interior region 22 of the first member 12 of the key locator 110 is draped, hung over or clasped to the upper edge 29 to create the suspension effect. The altitude of the bottom of the key locator 110 and keys will depend upon the length of the key locator 110 relative to the depth of the side panel of the bag-like purse. However, regardless of the precise altitude of the keys or other objects within the bag-like purse, they may be readily located due to the visible presence of the container 40.

In FIGS. 4 through 6, first member 12 has a rod-like appearance. That is, first member 12 is slender so that it can be easily gripped and removed from a bag-like container such as a purse. There is no requirement that first member 12 have the cylindrical shape depicted in FIGS. 4 through 6. Any slender shape form that enables the easy removal of key locator 110 from a bag-like purse is within the scope of the present disclosure. For example, first member 12 can be a flattened wire or other flat element. In another example, in some embodiments, the first member 12 has a flat rod-like shape characterized by a cross-section having first and second orthogonal dimensions in which the first dimension defines the thickness of the first member 12 and is between 0.01 cm and 0.5 cm and the second dimension defines the width of the first member 12 and is between 0.1 cm and 2 cm. In another example, in some embodiments, the first member 12 has a flat rod-like shape characterized by a cross-section having first and second orthogonal dimensions in which the first dimension defines the thickness of the first member 12 and is between 0.05 cm and 0.8 cm and the second dimension defines the width of the first member 12 and is between 0.2 cm and 3 cm.

In some embodiments, the bent interior region 22 is u-shaped. In some embodiments, the bent rod-shaped first member 12 is characterized by a cross-sectional bounding shape that is circular. In some embodiments, the bent rod-shaped first member 12 is characterized by a cross-sectional bounding shape that is ovoid. In some embodiments, the bent rod-shaped first member 12 is characterized by a cross-sectional bounding shape having one or more smooth curved surfaces or a splice of one or more smooth curved surfaces. In some embodiments, the bent rod-shaped first member 12 is characterized by a cross-sectional bounding shape having an arcuate edge. In some embodiments, the bent rod-shaped first member 12 is characterized by different cross-sectional bounding shapes at different portions of the first member 12.

Although the figures illustrate the first member 12 in which end portions are parallel to each other and are straight, the present disclosure is not so restricted. The first and second end portions 12*a* and 12*b* of the first member 12 of the key locator 110 may bend toward or away from each other. Moreover, the first and second end portions of the first member 12 may internally include any number of bends. Moreover, the first and second end portions of the first member 12 may be magnetized and the bent-shaped region may contain a hinge.

Third Embodiment

Another embodiment provides a key locator that is similar to the second embodiment. The key locator comprises, in combination: a) a bent rod-shaped first member having a first end portion and a second end portion, b) a second member configured for selectively retaining at least one key, and c) a container that is rotatably mounted to the second end portion of the bent rod-shaped first member. The first end portion and the second end portion are opposed to each other. The bent rod-shaped first member incorporates a bent interior region between the first end portion and the second end portion. The first end portion and the second end portion are not urged against each other and are configured to allow said bent interior region to hang from or clasps an edge. The first end portion of the bent rod-shaped first member substantially permanently and flexibly engages with the second member. The container comprises a hinge that attaches a first face to the container. The first face is configured to move between (i) an open configuration that exposes an interior portion of the container, and (ii) a closed configuration that seals the interior portion of the container.

In some embodiments, the first end portion of the bent rod-shaped first member comprises a hook for substantially permanently and flexibly engaging with the second member. The second member comprises a closed form clasp or ring that is configured for selectively retaining at least one key. The closed form clasp or ring is rotatably fixed to a u-shaped element of the second member. The u-shaped element is substantially permanently and flexibly engaged with the hook. In some embodiments, the closed form clasp or ring is substantially permanently and flexibly engaged with the hook. In some embodiments, the closed form clasp or ring is engaged with a closed form member and the closed form member is substantially permanently and flexibly engaged with the hook. In some embodiments, the closed form clasp or ring is engaged with a closed form member and the closed form member is a ring that is substantially permanently and flexibly engaged with the hook. In some embodiments, the closed form clasp or second ring is engaged with a chain, where the chain is substantially permanently and flexibly engaged with the hook. In some embodiments, the closed form clasp or second ring is engaged with first interlocking ring in a plurality of interlocking closed form elements, where an interlocking closed form element in the plurality of interlocking closed form elements is substantially permanently and flexibly engaged with the hook. In some embodiments, a closed form element in the plurality of closed form elements is a ring, an oval, a polygon, or a star-shape.

In still other embodiments, the first end portion of said bent rod-shaped first member comprises a first ring for substantially permanently and flexibly engaging with the second member and the second member comprises a closed form clasp or second ring that is configured for selectively retaining at least one key. In some such embodiments, the closed form clasp or second ring is rotatably fixed to a u-shaped element of the second member, where the u-shaped element is substantially permanently and flexibly engaged with the first ring. In some such embodiments, the closed form clasp or second ring is substantially permanently and flexibly engaged with the first ring. In some such embodiments, the closed form clasp or second ring is engaged with a closed form member, wherein the closed form member is substantially permanently and flexibly engaged with the first ring. In some such embodiments, the closed form clasp or second ring is engaged with a closed form member, where the closed form member is a third ring that is substantially permanently and flexibly engaged with the first ring. In some such embodiments, the closed form clasp or second ring is engaged with a chain, where the chain is substantially permanently and flexibly engaged with the first ring. In some such embodiments, the closed form clasp or second ring is engaged with first interlocking closed form element in a plurality of interlocking closed form elements, where a second interlocking closed form elements in the plurality of interlocking closed form elements is substantially permanently and flexibly engaged with the first ring.

Fourth Embodiment

Another aspect provides a method comprising retaining at least one key by a second member 14 of an apparatus that comprises at least the second member 14 and a bent rod-shaped first member 12. The second member is configured for selectively retaining at least one key. The bent rod-shaped first member 12 of the apparatus has a first end portion 12*a* and a second end portion 12*b*. The first end portion 12*a* and the second end portion 12*b* are opposed to each other. The bent rod-shaped first member 12 incorporates a bent interior region 22 between the first end portion 12*a* and the second end portion 12*b*. The first end portion 12*a* and the second end portion 12*b* are not urged against each other and are configured to allow the bent interior region 22 to hang from or clasps an upper edge of a side panel of a bag-like purse. The first end portion 12*a* of the bent rod-shaped first member 12 substantially permanently and flexibly engages with some portion of the second member 14. The second end portion 12*b* of the bent rod-shaped first member 12 is affixed to a container 40. The method further comprises hanging the apparatus from the upper edge 29 of the side panel of a bag-like purse with the bent interior region 22 overhanging the side panel so that the second end portion 12*b* and the container 40 are exposed. The method further comprises retrieving the bent rod-shaped first member of the apparatus from the upper edge such that, when the bent rod-shaped first member is retrieved from the upper edge, the at least one key retrained by the second member is necessarily retrieved. In some embodiments, the container comprises a hinge that attaches the first face to the container. The first face is configured to move between (i) an open configuration that exposes an interior portion of the container, and (ii) a closed configuration that seals the interior portion of the container and the method further comprises operating the first face so that the face switches between the closed configuration to the open configuration.

Thus, it can be seen that the present invention provides a key locator especially suitable for use with a purse, backpack, briefcase or other bag-like device. By employing the key locator of the invention in conjunction with such a device, one may find keys stored within without delay. Further, by providing a decorative ornament for indicating the location of the key locator, the appearance of the bag is enhanced.

REFERENCES CITED AND ALTERNATIVE EMBODIMENTS

All references cited herein are incorporated herein by reference in their entirety and for all purposes to the same extent as if each individual publication or patent or patent application was specifically and individually indicated to be incorporated by reference in its entirety for all purposes.

Many modifications and variations of this invention can be made without departing from its spirit and scope, as will be apparent to those skilled in the art. The specific embodiments described herein are offered by way of example only. The embodiments were chosen and described in order to best explain the principles of the invention and its practical applications, to thereby enable others skilled in the art to best utilize the invention and various embodiments with various modifications as are suited to the particular use contemplated. The invention is to be limited only by the terms of the appended claims, along with the full scope of equivalents to which such claims are entitled.

What is claimed:

1. A key locator comprising, in combination:

a) a bent rod-shaped first member having a first end portion and a second end portion;

b) a second member configured for selectively retaining at least one key; and c) a container comprising a first face that is configured to move between (i) an open configuration that exposes an interior portion of the container, and (ii) a closed configuration that seals the interior portion of the container; wherein said bent rod-shaped first member incorporates a planar bent interior region between said first end portion and said second end portion;

said first end portion and said second end portion are not urged against each other and are configured to allow said planar bent interior region to hang from or clasp an edge;

said first end portion of said bent rod-shaped first member comprises a hook in either an open form shape or a closed form shape that substantially permanently and flexibly engages with the second member;

said second end portion of said bent rod-shaped first member is configured for affixation of said container so that, when affixed to the second end portion of said bent rod-shaped first member, the container is substantially rigidly affixed to the second end portion of said bent rod-shaped first member such that movement of the container necessarily causes movement of the second end portion of said bent rod-shaped first member;

said first face of said container is exposed and faces away from an interior of the bent rod-shaped first member when said container is directly and permanently fixed to the second end portion of the bent rod-shaped first member, wherein the interior of the bent rod-shaped first member is defined by the planar bent interior region between the first end portion and the second end portion;

the second end portion of the bent rod-shaped first member comprises an enlarged portion; and the container further comprises a second face that is opposite to the first face of the container, wherein the second face of the container is directly and permanently fixed to the enlarged portion.

2. The key locator of claim 1, wherein the enlarged portion comprises a solid face to which a portion of the second face of the container is directly and permanently fixed.

3. The key locator of claim 1, wherein the enlarged portion comprises a solid face to which a portion of the second face is soldered.

4. The key locator of claim 1, wherein the second face of the container is soldered to the enlarged portion of the second end portion of the bent rod-shaped first member.

5. The key locator of claim 1, wherein the container forms a part of the second end portion of the bent rod-shaped first member.

6. The key locator of claim 1, wherein the bent rod-shaped first member and the second member each independently comprise a material selected from the group consisting of metal and plastic.

7. The key locator of claim 1, wherein said bent rod-shaped first member and said second member each independently comprise gold, silver, steel, nickel, aluminum, an alloy thereof, or any combination thereof.

8. The key locator of claim 1, wherein said bent rod-shaped first member and said second member are each made of metal.

9. The key locator of claim 1, wherein said bent rod-shaped first member or said second member comprises urethane polymer, an acrylic polymer, a fluoropolymer, polybenzamidazole, polyimide, polytetrafluoroethylene, polyetheretherketone, polyamideimide, glass-based phenolic, polystyrene, cross-linked polystyrene, polyester, polycarbonate, polyethylene, polyethylene, acrylonitrile-butadiene-styrene, polytetratluoro-ethylene, polyrnethacrylate, nylon 6,6, cellulose acetate butyrate, cellulose acetate, rigid vinyl, plasticized vinyl, or polypropylene.

10. The key locator of claim 1, wherein the edge is an upper edge of a side panel of a bag-like purse.

11. The key locator of claim 10, wherein the bag-like purse is a purse, a backpack, or a briefcase.

12. The key locator of claim 1, wherein said bent rod-shaped first member and said second member are configured so that when the bent rod-shaped first member is retrieved from the edge, the second member is necessarily retrieved.

13. The key locator of claim 1, wherein the planar bent interior region is u-shaped.

14. The key locator of claim 1, wherein the bent rod-shaped first member is characterized by a cross-sectional bounding shape that is circular.

15. The key locator of claim 1, wherein the bent rod-shaped first member is characterized by a cross-sectional bounding shape that is ovoid.

16. The key locator of claim 1, wherein the bent rod-shaped first member is characterized by a cross-sectional bounding shape having an arcuate edge.

17. The key locator of claim 1, wherein said first end portion and said second end portion are configured so that a force of between 1 dyne and 2000 dynes is required to remove the key locator from said edge at a time when said planar bent interior region hangs from or clasps an edge.

18. The key locator of claim 1, wherein said first end portion and said second end portion are configured so that a force of between 1 dyne and 1000 dynes is required to remove the key locator from said edge at a time when said planar bent interior region hangs from or clasps an edge.

19. The key locator of claim 1, wherein said first end portion and said second end portion are configured so that a force of between 1 dyne and 500 dynes is required to remove the key locator from said edge at a time when said planar bent interior region hangs from or clasps an edge.

20. The key locator of claim 1, wherein said first end portion and said second end portion are configured so that a force of between 1 dyne and 250 dynes is required to remove the key locator from said edge at a time when said planar bent interior region hangs from or clasps an edge.

21. The key locator of claim 1, wherein said first end portion and said second end portion are configured so that a force of between 100 dynes and 2000 dynes is required to remove the key locator from said edge at a time when said planar bent interior region hangs from or clasps an edge.

22. The key locator of claim 1, wherein said first end portion and said second end portion are configured so that a force of between 100 dynes and 1000 dynes is required to remove the key locator from said edge at a time when said planar bent interior region hangs from or clasps an edge.

23. The key locator of claim 1, wherein said first end portion and said second end portion are configured so that a force of between 100 dynes and 500 dynes is required to remove the key locator from said edge at a time when said planar bent interior region hangs from or clasps an edge.

24. The key locator of claim 1, wherein said first end portion and said second end portion are configured so that a force of between 100 dynes and 250 dynes is required to remove the key locator from said edge at a time when said planar bent interior region hangs from or clasps an edge.

25. The key locator of claim 1, wherein said container comprises a hinge that attaches said first face to said container.

26. The key locator of claim 1, wherein said container comprises a swivel hinge that attaches said first face to said container, and wherein said first face is configured to slide between (i) the open configuration, and (ii) the closed configuration.

27. The key locator of claim 1, wherein the first face is adorned with an ornament.

28. The key locator of claim 27, wherein the ornament comprises an artificial or a real gem.

29. The key locator of claim 1, wherein the container comprises a material selected from the group consisting of metal and plastic.

30. The key locator of claim 1, wherein the container comprises gold, silver, steel, nickel, aluminum, an alloy thereof or any combination thereof.

31. The key locator of claim 1, wherein the container comprises urethane polymer, an acrylic polymer, a fluoropolymer, polybenzamidazole, polyimide, polytetrafluoroethylene, polyetheretherketone, polyamide-imide, glass-based phenolic, polystyrene, cross-linked polystyrene, polyester, polycarbonate, polyethylene, polyethylene, acrylonitrile-butadiene-styrene, polytetrafluoro-ethylene, polymethacrylate, nylon 6,6, cellulose acetate butyrate, cellulose acetate, rigid vinyl, plasticized vinyl, or polypropylene.

32. The key locator of claim 1, wherein the container is configured to store a gel or an object.

33. The key locator of claim 1, wherein the container is configured to store an object.

34. The key locator of claim 1, wherein the first end portion of said bent rod-shaped first member comprises a hook for substantially permanently and flexibly engaging with the second member; and the second member comprises a closed form clasp or ring that is configured for selectively retaining at least one key.

35. The key locator of claim 34, wherein the closed form clasp or ring is rotatably fixed to a u-shaped element of said second member, wherein the u-shaped element is substantially permanently and flexibly engaged with the hook.

36. The key locator of claim 34, wherein the closed form clasp or ring is substantially permanently and flexibly engaged with the hook.

37. The key locator of claim 34, wherein the closed form clasp or ring is engaged with a closed form member, wherein the closed form member is substantially permanently and flexibly engaged with the hook.

38. The key locator of claim 34, wherein the closed form clasp or ring is engaged with a closed form member, wherein the closed form member is a ring that is substantially permanently and flexibly engaged with the hook.

39. The key locator of claim 34, wherein the closed form clasp or second ring is engaged with a chain, wherein the chain is substantially permanently and flexibly engaged with the hook.

40. The key locator of claim 34, wherein the closed form clasp or second ring is engaged with first interlocking closed form element in a plurality of interlocking closed form elements, wherein a second interlocking closed form element in the plurality of interlocking closed form elements is substantially permanently and flexibly engaged with the hook.

41. The key locator of claim 40, wherein a closed form element in the plurality of closed form elements is a ring, an oval, a polygon, or a star-shape.

42. The key locator of claim 1, wherein the first end portion of said bent rod-shaped first member comprises a first ring for substantially permanently and flexibly engaging with the second member; and the second member comprises a closed form clasp or second ring that is configured for selectively retaining at least one key.

43. The key locator of claim 42, wherein the closed form clasp or second ring is rotatably fixed to a u-shaped element of said second member, wherein the u-shaped element is substantially permanently and flexibly engaged with the first ring.

44. The key locator of claim 42, wherein the closed form clasp or second ring is substantially permanently and flexibly engaged with the first ring.

45. The key locator of claim 42, wherein the closed form clasp or second ring is engaged with a closed form member, wherein the closed form member is substantially permanently and flexibly engaged with the first ring.

46. The key locator of claim 42, wherein the closed form clasp or second ring is engaged with a closed form member, wherein the closed form member is a third ring that is substantially permanently and flexibly engaged with the first ring.

47. The key locator of claim 42, wherein the closed form clasp or second ring is engaged with a chain, wherein the chain is substantially permanently and flexibly engaged with the first ring.

48. The key locator of claim 42, wherein the closed form clasp or second ring is engaged with first interlocking ring in a plurality of interlocking rings, wherein a second interlocking ring in the plurality of interlocking rings is substantially permanently and flexibly engaged with the first ring.

49. The key locator of claim 1 wherein all or a portion of the bent-rod shaped member is electroplated.

* * * * *